US006581401B1

(12) United States Patent
Anthony

(10) Patent No.: US 6,581,401 B1
(45) Date of Patent: Jun. 24, 2003

(54) SELF-COOLING CONTAINER WITH PHASE LOCKED REFRIGERANT AND PROCESS OF MANUFACTURING THE SAME

(76) Inventor: Michael M. Anthony, 10189 W. Sample Rd., Coral Springs, FL (US) 33065

( * ) Notice: Subject to any disclaimer, the term of this patent is extended or adjusted under 35 U.S.C. 154(b) by 0 days.

(21) Appl. No.: 10/085,535

(22) Filed: Mar. 1, 2002

(51) Int. Cl.[7] ..... F25D 3/08

(52) U.S. Cl. ..... 62/293; 62/294; 62/371

(58) Field of Search ..... 62/293, 294, 371, 62/457.3, 457.4

(56) References Cited

U.S. PATENT DOCUMENTS

| | | | | | |
|---|---|---|---|---|---|
| 3,373,581 | A | * | 3/1968 | Strader | 62/294 |
| 5,331,817 | A | * | 7/1994 | Anthony | 62/5 |
| 6,065,300 | A | * | 5/2000 | Anthony | 62/293 |
| 6,105,384 | A | * | 8/2000 | Joseph | 62/293 |
| 6,151,911 | A | * | 11/2000 | Dando et al. | 62/457.3 |
| 6,167,718 | B1 | * | 1/2001 | Halimi et al. | 62/293 |

* cited by examiner

*Primary Examiner*—William E. Topolcai
(74) *Attorney, Agent, or Firm*—Oltman, Flynn & Kubler

(57) ABSTRACT

A self-cooling container with an internal receptacle. The receptacle responds to differences in pressure between its internal and external walls so that when the pressure acting external to the receptacle walls falls to atmospheric pressure the receptacle releases cooling agents that cool the contents of the container.

12 Claims, 22 Drawing Sheets

SELF-COOLING CONTAINER WITH PHASE LOCKED REFRIGERANT AND PROCESS OF MANUFACTURING THE SAME

BACKGROUND OF THE INVENTION

1. Field of the Invention

The present invention relates generally to the field of food and beverage containers and to processes for manufacturing such containers. More specifically the present invention relates to a self-cooling container apparatus containing a beverage or other food product, a method of cooling said food products, and to methods of assembling and operating the apparatus. The terms "beverage," "food," "food products" and "container contents" are considered as equivalent for the purposes of this application and used interchangeably.

2. Description of the Prior Art

There have previously been self-cooling containers for cooling the contents such as food or beverages that include flexible and deformable refrigerant receptacles with widely spaced apart, rigid receptacle walls, and methods of manufacturing these containers. These prior art do not address the real issues of manufacturing and beverage plant operations that are crucial for the success of a self-cooling beverage container program. All prior art designs fail when subjected to the immense pressures (about 45–60 psi) of the carbonated filling process and fail to maintain the container column strength. The sudden blast of carbon-dioxide inside a container during filling, can destroy any thin-walled internal container, and collapse its walls so that the functionality of the apparatus will be impaired. Also, the sudden collapse of such internal containers, can cause the can itself to loose column strength, and collapse under the clamping force that is applied for sealing the can during filling. Many trials and designs were done to obtain the present configuration of the disclosed receptacle of this invention.

For example when an internal receptacle is used as a refrigerant storage receptacle, the beverage filler head pressurizes its external walls and crushes the receptacle, since such receptacles are generally made from thin walled materials for rapid heat transfer, they can be easily crushed by external pressure and cannot survive the forces of the high speed manufacturing process. Thus, failure of the internal receptacle, can also result in the sudden collapse of the container walls. Even with prior designs of co-seamed internal receptacles such as that described in U.S. Pat. No. 6,065,300 to the present inventor the problem was still not solved. Also, the high speed beverage plants require high speed compatible operations for manufacture of an online self-cooling beverage container. For example, prior art designs do not address easy insertion, self-aligning of the receptacle with the container and so on. Further, most prior art relies on a separate unintegrated manufacturing process for the attachment of the receptacle to the container. The prior art differs from the current disclosed invention in that they all require complicated valving for activation of the cooling process. Most use rubber seals, gaskets and expensive attachment means. The present invention does not require a special valving system. Just two parts that form the receptacle and the attachment means to the can suffice to form a self acting valve based on the opening of the container for consumption.

SUMMARY OF THE INVENTION

The present invention accomplishes the above-stated objectives, as well as others, as may be determined by a fair reading and interpretation of the entire specification.

For the preferred of several possible embodiments, the apparatus includes a conventional beverage or food container such as a metal or plastic can for containing a product to be consumed. The container has a conventional unified domed bottom wall, and a cylindrical side container wall terminating in an upper container sealing rim. A container sealing lid is also provided for sealing off the container contents inside the container. A hole passes through the center of the domed bottom wall of the container making fluid communication between the inside and the outside of the container. The apparatus further comprises a thin walled plastic or metal receptacle with substantially the shape of a small plastic or metal bottle with a bottle neck. With the said receptacle oriented so that it sits on a bottom wall rim and with the open bottle neck facing an upwardly direction, the receptacle comprises a substantially horizontal round top wall with an upward facing surface and a downward facing surface. From the center of the upward facing surface is joined a short smaller diameter cylindrical receptacle neck protrusion which terminates with a thin receptacle open neck round flange. Said receptacle open neck flange having a slightly larger diameter than the cylindrical receptacle neck. The receptacle top wall has a diameter that is greater than the diameter of the receptacle open neck protrusion. The top wall and the receptacle neck form a continuous unified wall of the receptacle with the receptacle open neck also passing through the receptacle top wall as an entry way for ingredients that are to be stored inside the receptacle. A receptacle side wall sealingly joins the receptacle top wall protruding in the downward direction to sealingly join a substantially round receptacle bottom wall. Thus, the receptacle walls are all joined together to form continuous bottle with an open neck. The receptacle bottom wall is designed to be slightly flexible and to flex up and down the axis of the receptacle, so as to increase the overall length of the receptacle when the pressure acting inside the receptacle walls is greater than the pressure acting outside the receptacle walls. In general the walls of the receptacle are flexible and thin relative to its size. The receptacle is designed to be handled easily for manufacturing the self-cooling container so that the processes that would be encountered during the manufacturing would be easily accomplished because of the way the receptacle is designed and works. The receptacle is designed to store a liquified refrigerant or a matrix held refrigerant such as a combination of CO2 and carbon atoms, at a minimal pressure difference across its walls by means of equilibration with beverage pressure, and when the refrigerant pressure acting inside the receptacle walls equilibrates with beverage pressure acting outside the receptacle walls. The refrigerant may be designed as a slurry of an activated carbon matrix with CO2 gas trapped inside the matrix. The receptacle sealed bottom wall is flexible. A substantially conical valve seat protrusion protrudes outwardly in a downward direction from the center of the receptacle bottom wall. The inside wall of the valve seat recess is designed to sealingly mate with the outer bottom edge of a substantially tubular stem valve, so that liquified refrigerant contained inside the receptacle will not boil and escape from within the receptacle when the pressure outside the receptacle is greater than the pressure of the refrigerant gas contained inside the receptacle. Advantageously, the receptacle valve seat recess will not form a seal with the stem valve outer bottom edge if the outside pressure acting on the receptacle walls is less than the liquified refrigerant pressure acting on inside walls of the receptacle.

The apparatus further comprises a stem valve for mating with the receptacle. The stem valve is a substantially tubular valve with a sealing cup flange attached near one end of the stem valve. The sealing cup flange is shaped like a shallow bowl of a diameter of approximately 1 inch and a depth of about ¼ inch, for sealing against the bottom wall of the beverage container. A short cylindrical tube of a length of about ½ inches and diameter ⅜ inch protrudes from the outer surface of the sealing cup flange and connects to a conical tube stem valve body of a length of about 3 inches. The dimensions given are only for the sake of comparative clarity of the present invention, and should not be construed as the only possible dimensions for the parts of the apparatus. A short small cylindrical stud protrudes from the inside surface of the sealing cup flange in the opposite direction to the stem valve body. The approximate diameter of the stud is about ¼ inch, but it could be larger or smaller depending on the size of the beverage container the apparatus is designed for. A small stem valve hole passes through the entire length of the stem valve. The stem valve hole could be made larger inside the stem valve body, for reasons of ease of manufacturing. However, the hole that passes through the stud must be close to 0.04 inches diameter. Again all of the dimensions sited are examples of one embodiment of the invention. The stem valve conical protrusion is designed to tightly push to form a swage fitting, or to snap into the hole through the domed bottom wall of the beverage container holding the receptacle and stem valve assembly centrally inside the beverage container. The sealing cup flange forms a tight gas seal against the domed bottom wall of the beverage container when the stem valve stud is tightly affixed into the container bottom wall hole.

In one embodiment of the invention, the apparatus is assembled by first affixing the stem valve into the receptacle by passing the stem valve body through the receptacle open neck, so that the receptacle stem valve cylindrical body seals against the receptacle neck cylinder, and the outside surface of the stem valve sealing cup flange sealingly mates to the surface of the receptacle open neck flange. The stem valve cylinder is designed to fit snugly and tightly into the receptacle open neck so that a gas tight plug is formed around the receptacle open neck protrusion. The stem valve is made long enough so that when the stem valve sealing cup flange mates with the receptacle open neck flange, the stem valve outer bottom edge also sealingly abuts the inside side wall of the receptacle valve seat recess. Thus, when the stem valve outer bottom edge abuts the inside side wall of the receptacle valve seat recess, pressurized gas cannot escape through the stem valve hole, or through the receptacle open neck protrusion, when the pressure inside the receptacle is less than the pressure outside the receptacle. And when the pressure inside the receptacle is greater than the pressure outside the receptacle the receptacle valve seat recess is expanded and moves away from the stem valve outer bottom edge so that pressurized gas can escape through the stem valve hole. Other methods of practicing the invention do not require that the stem valve bottom edge seal the inside wall of the receptacle valve seat recess when the stem valve flange is fully seated on the receptacle open neck flange. It is important that the stem valve outer bottom edge be close to or actually contact the inside surface of the receptacle valve seat, so that if the pressure inside the receptacle is less than the pressure outside the receptacle, the receptacle bottom wall is deflected inwardly to make contact between the inner surface of the receptacle valve seat recess and the outer bottom edge of the stem valve to form a gas tight seal that traps any liquified or gaseous refrigerant inside the receptacle from escaping to the outside through the stem valve hole.

To manufacture the apparatus, the receptacle is first filled with clean water. The stem valves are then inserted into the receptacle through the receptacle open neck to displace some water and form a seal with the receptacle open neck and the receptacle valve seat recess inside surface. Thus the water is trapped inside the receptacle and cannot pass through the stem valve hole, or the receptacle open neck. The assembly is then inserted into the beverage container, and the stem valve stud is aligned and pushed through the container bottom wall hole. The stem valve stud is made slightly larger in diameter than the diameter of the container bottom wall hole, so that as the stem valve stud pushes through the container bottom wall hole, the stem valve stud forces the container bottom wall hole rim to form a slightly conical depression around the rim forming a thin wall of conical material protruding out of the container. This conical ring of material forms a tight swage fitting that holds the stud firmly in place on the container and so does not allow the assembly to be easily removed from the hole. A snap action may also be used for this attachment. The deforming of the hole into a substantially conical rimed hole, causes the container wall material to bight into of the softer valve stud material and form a hematic seal, and a very tight strangle hold on the valve stud. The stem valve is pushed into the container bottom hole until the stem valve sealing cup flange makes a tight cup seal between the stem valve and the container bottom wall. The assembly is then transported to a beverage filling plant, where the apparatus is filled with beverage product under carbonation pressure.

During the beverage filling process, a filler head is sealed against the beverage container rim. Nitrogen or carbonation pressure is transmitted from the beverage filler head to the inside space of the beverage container. This pressure is also fully transmitted to the receptacle outer walls. The pressure within the receptacle builds up and equilibrates with the pressure of gas inside the beverage container. The pressure outside the receptacle causes the receptacle bottom wall to deform slightly, pushing against the trapped water in the receptacle until the receptacle valve seat recess inside wall seals tightly against the outer bottom edge of the stem valve. This stops any water from escaping from the receptacle. Since the receptacle is now filled with only water, and water is essentially incompressible, minimal deformation of the receptacle walls occurs preventing any damage to the thin receptacle walls. The pressurization of the container with carbon-dioxide gas is important when carbonated beverage are being filled to ensure that the carbonation of the beverage occurs during the filling process. The beverage itself is usually carbonated when it enters the container, where, because of the absorption of pressurized carbon-dioxide gas, it becomes highly carbonated. For a container without the receptacle, the container column strength is obtained by the filler head firmly forming a seal with the empty open container rim and pressurizing the container directly with a blast of carbon-dioxide gas. The column strength of the container is obtained by the internal pressure of the container. This allows the filler head to firmly seal the rim of the container to maintain the pressure of the beverage during the filling process. Thus it is important that the above steps be taken in manufacturing a useful self-cooling beverage container. Absence of water could cause the receptacle walls to collapse and prevent column strength from building up, thus causing the container to collapse under the filler head forces. Thus, during filling, the receptacle advantageously transmits the filler head forces directly to the water without subjecting the container walls or the receptacle walls to deformation stresses.

The method of manufacture of the receptacle generally involves the broad steps of injection molding preforms from suitable plastic materials; blow molding the receptacle to a shape of particular form; orienting the receptacle for filling with water; inserting the stem valve into the receptacle; and insertion the assembly into beverage containers so that the stem valve stud is pushed ti a tight fit into the container bottom wall hole; filling the beverage container with beverage; seaming the container lid onto the container rims; checking for carbonation column strength of the filled and seamed container. The steps further comprise; the broad steps of ejecting the water in the receptacle by pressure feeding a small dose of higher liquified refrigerant into the receptacle through the stem valve hole; said refrigerant opening the seal made between the valve seat recess and the outer bottom edge of the stem valve body; using a high pressure piston charger to charge liquified refrigerant through the stem valve hole into the receptacle; storing the apparatus for later sale or use by a consumer.

It is important to know that the liquified phase of the refrigerant or the refrigerant/carbon matrix to be used for cooling must be at a lower pressure than the beverage carbonation pressure. This is a requirement of the invention, since the beverage pressure must be able to overcome the internal pressure of the refrigerant inside the receptacle, to force the receptacle valve seat recess to form a seal with the stem valve outer bottom edge. This is because as the pressure in the beverage container builds up, it compresses the receptacle walls and forces the larger surface area of the receptacle bottom wall inward into receptacle toward the stem valve bottom edge. However, since the area exposed to the refrigerant pressure inside the valve seat recess is smaller than the outer surface area exposed to beverage carbonation pressure by the amount of the area trapped by the receptacle valve seat recess and the stem valve outer bottom edge, and since the carbonation pressure is higher than the beverage pressure, the valve seat and stem valve outer bottom edge will seal off the stem valve hole from the refrigerant completely. If careful calculations are made, it is possible to have the refrigerant pressure equal or greater than the carbonation pressure by adjusting the area of exposed valve seat sealed off area. This makes it possible to use other suitable refrigerants. The difference in pressure can be estimated by the following formula:

$$P_R \leq \frac{(P_B - P_S)D^2}{(D^2 - d^2)}$$

where $P_R$ is the maximum pressure of the refrigerant to be used, $P_B$ is the pressure of the carbonated beverage, and $P_S$ is the security difference in pressure to be used for the sealing of the refrigerant during storage, and D is the diameter of the bottom receptacle wall, and d is the diameter of the outer bottom edge of the stem valve. $P_S$ is nominally found to be about 5 psi under normal temperature conditions in Florida. In other countries, the value of $P_S$ will depend on the variability of the carbonation pressure and the refrigerant pressure with ambient conditions, particularly, temperature.

Thus by adjusting any of these parameters, the refrigerant pressure could be determined for any given stem valve and receptacle dimensions and given beverage pressure. This offers a great variability in the possible types of gases that could be used for cooling the beverage, and a variety of embodiments could be used.

Since by design the carbonation pressure will always form a seal for the refrigerant gas in the receptacle, the removal of the trapped water in the receptacle is a little demanding. This is achieved by using a higher pressure liquid dose refrigerant other than the refrigerant to be stored in the receptacle. This small liquid dose of refrigerant must always produce a force that tends to open the valve seal. This can be achieved if the pressure of the liquid dose refrigerant $P_D$. follows the relation, $$P_D > \frac{(P_B + P_S)D^2}{(D^2 - d^2)}.$$

For example if the carbonation pressure $P_B$=50 psi, and if D=1.86, d=0.25, with a safety pressure lock of $P_S$=5 psi, the refrigerant pressure must be given by, $$P_R \leq \frac{(50-5)1.86^2}{(1.86^2 - .25^2)} = 45.83psi$$

and the liquid dose refrigerant pressure required to evacuate the water from the receptacle must be greater than the value calculated by the formula, $$P_D > \frac{(50+5)1.86^2}{(1.86^2 - .25^2)} = 56.01psi$$

however, the surface area of the stem valve hole is far smaller than the area of the receptacle bottom wall, so that the pressure required be exerted through the stem valve hole to push back the receptacle valve seat away from the stem valve bottom outer edge is far greater than that of the liquified refrigerant alone. A higher pressure refrigerant may be used to achieved this. It is preferable that the refrigerant used to practice the invention have a lower vapor pressure in the liquified state than the beverage carbonation pressure. This allows the receptacle bottom wall to always force the receptacle valve seat back into a sealing position against the outer bottom edge of the stem valve. Thus, if water is to be displaced from the receptacle, a liquid dose refrigerant with a liquid phase pressure higher than carbonation pressure may be used but not stored in the receptacle. With the liquid dose refrigerant pressure higher than the carbonation pressure, the liquid dose refrigerant is able to maintain the stem valve and the receptacle valve seat in a relatively open state until all the water and liquid dose refrigerant has escaped from the receptacle. Some liquid dose refrigerant in a gaseous form will remain in the receptacle to keep the receptacle walls from collapsing under carbonation pressure. Upon complete or almost complete removal of the water from the receptacle, the liquified refrigerant charge or mixture that is to be stored in the receptacle is then injected through the stem valve hole into the receptacle by a pressure assist piston pump in a liquified state into the receptacle. This has the advantage of completely filling the receptacle with liquified refrigerant without deforming the receptacle walls. Alternatively if a carbon matrix is used to store some refrigerant, then the carbon matrix is first poured into the receptacle prior to inserting the stem valve. Upon completion of the charging, carbonation pressure pushes against the receptacle bottom wall to reseal the receptacle bottom wall conical protrusion against the stem valve outer bottom edge, trapping the liquified refrigerant inside the receptacle.

The completed apparatus is then stored or shipped to a customer for consumption. The process of activation involves simply opening the container lid for consumption, so that the carbonation pressure falls to atmospheric pressure, and the pressure of the liquified refrigerant acting on the internal walls of the receptacle becomes greater than atmospheric pressure, causing the receptacle bottom wall to push away from the stem valve outer bottom edge, and breaking the seal. Since the stem valve outer bottom edge is above the liquid level of the refrigerant, only gas is releases through the bottom of the container, when the container is upright. This also has the advantage of preventing anyone from playing with the apparatus until it is opened for consumption.

To operate the present invention for use as a self-cooling container, no additional activation means is provided that can be tampered with by a user. The beverage container opening means is opened for the container contents to be consumed. This simultaneously opens the receptacle valve and refrigerant mixture is progressively discharged from the receptacle, extracting heat from the container contents by means of evaporation.

A self-cooling container apparatus is further provided for retaining container contents such as food or beverages; and a container contents release mechanism for releasing the container contents from the container and also for effectuating the release of liquified gas stored in the receptacle.

A process of manufacturing the above-described self-cooling container apparatus is provided, including the steps of orienting the stem valves for insertion into the receptacles; filling the receptacles with water; inserting the stem valves into the receptacles; and inserting the assemblies into beverage containers; filling each beverage container with beverage; pumping a high pressure liquified refrigerant into the receptacle to exhaust the water from the receptacle; filling the receptacle with refrigerant; seaming or crimping the container lid onto the container.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
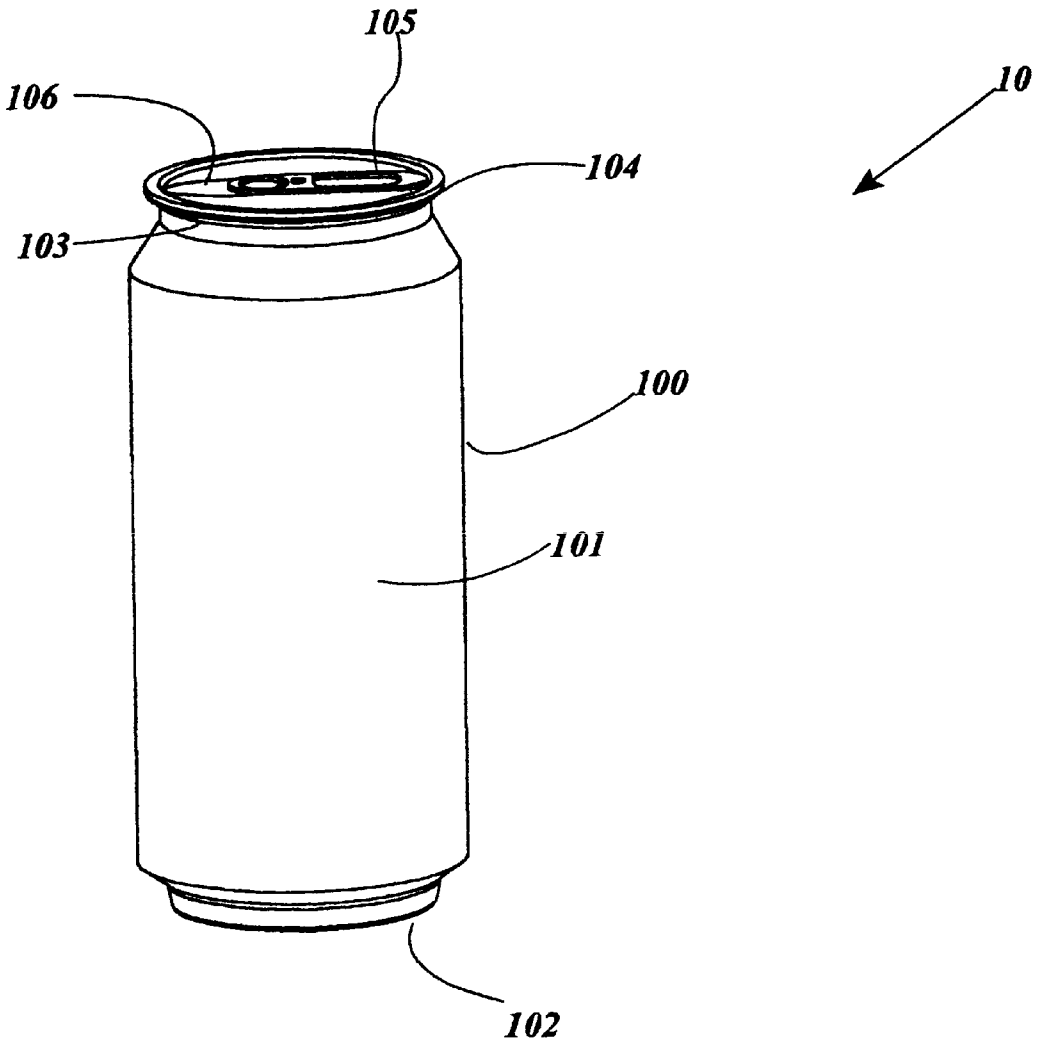
FIG. 1 shows a conventional beverage container with the lid seamed on the container.
Figure 2:
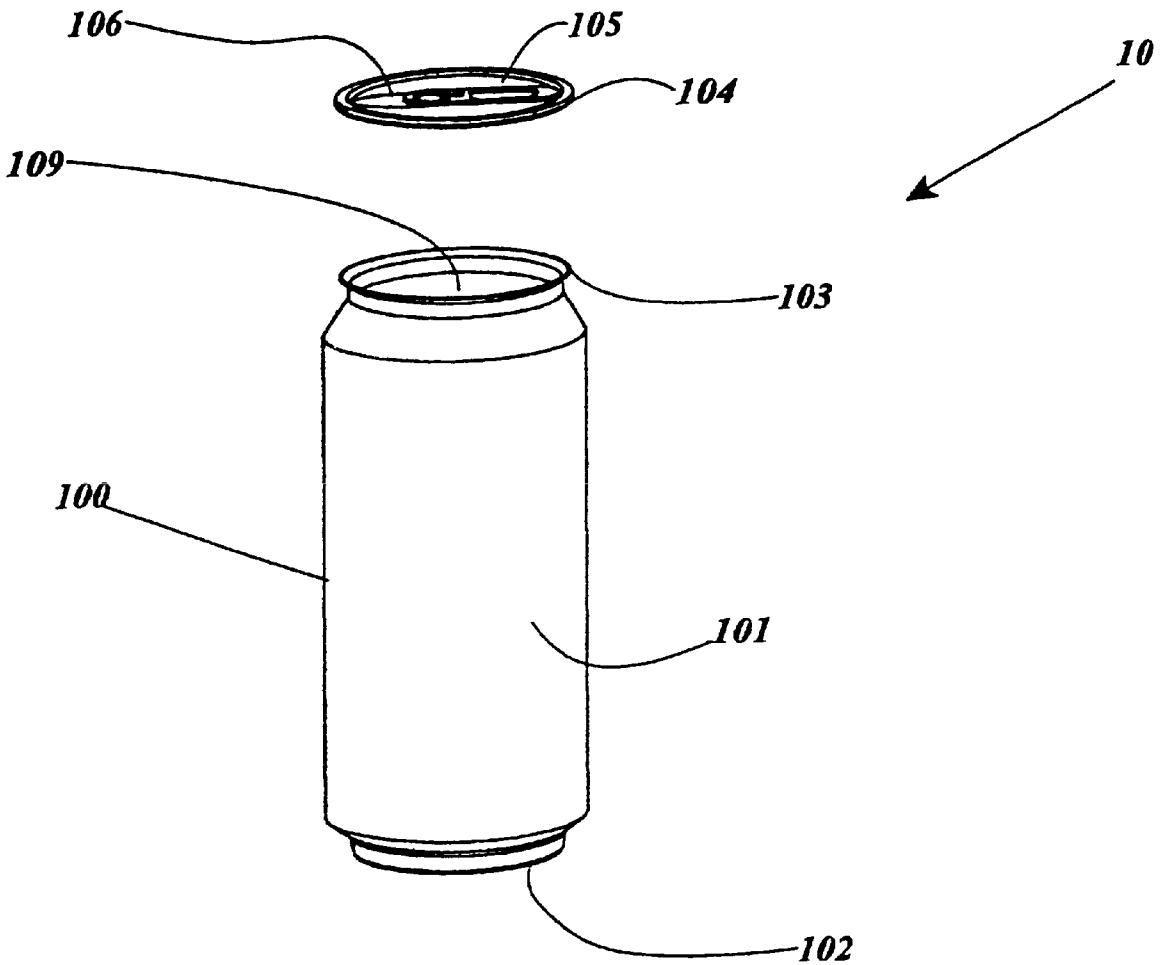
FIG. 2 shows the lid of the beverage container with an open beverage container.
Figure 3:
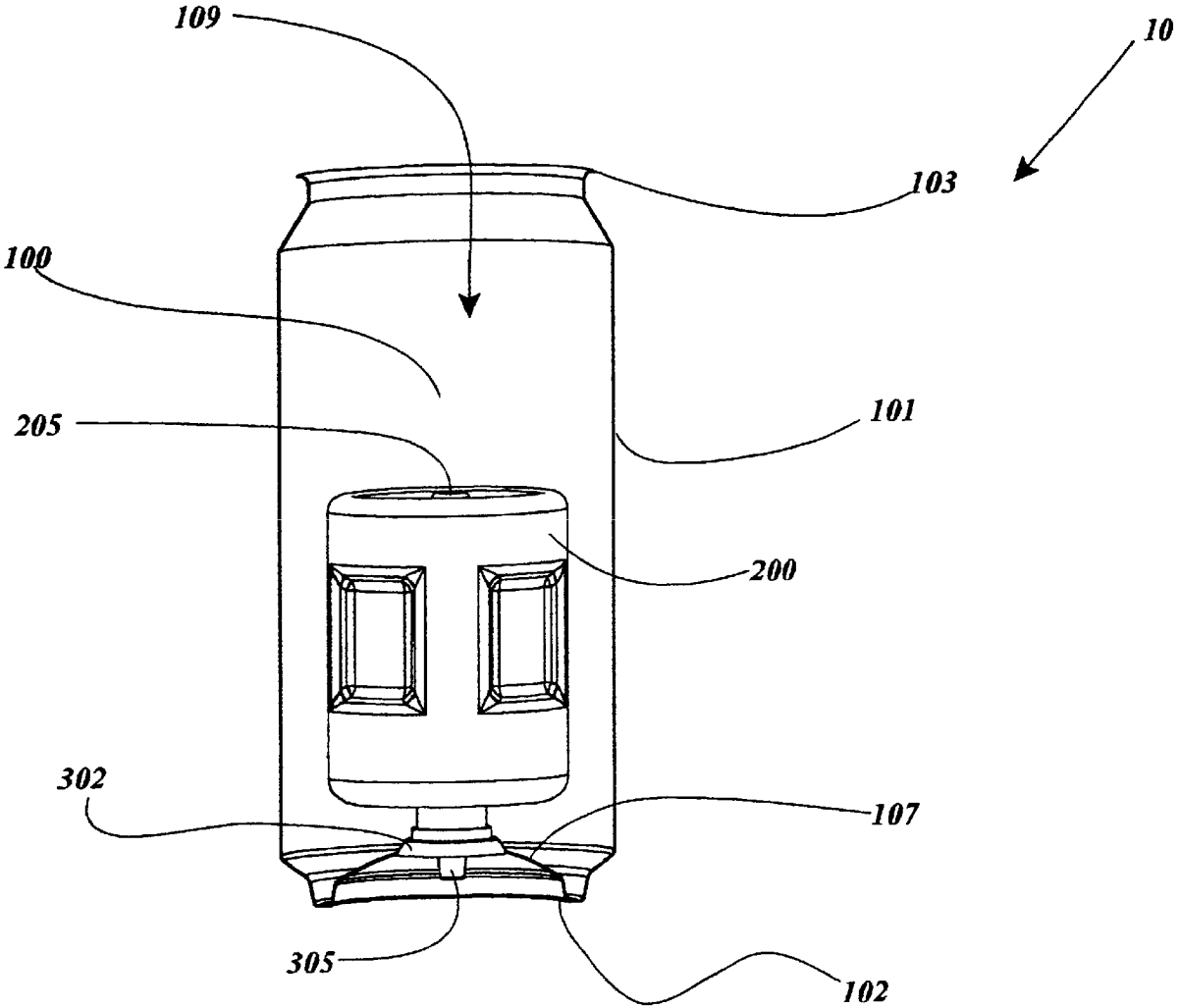
FIG. 3 shows the apparatus assembled with the receptacle and the stem valve in potion.
Figure 4:
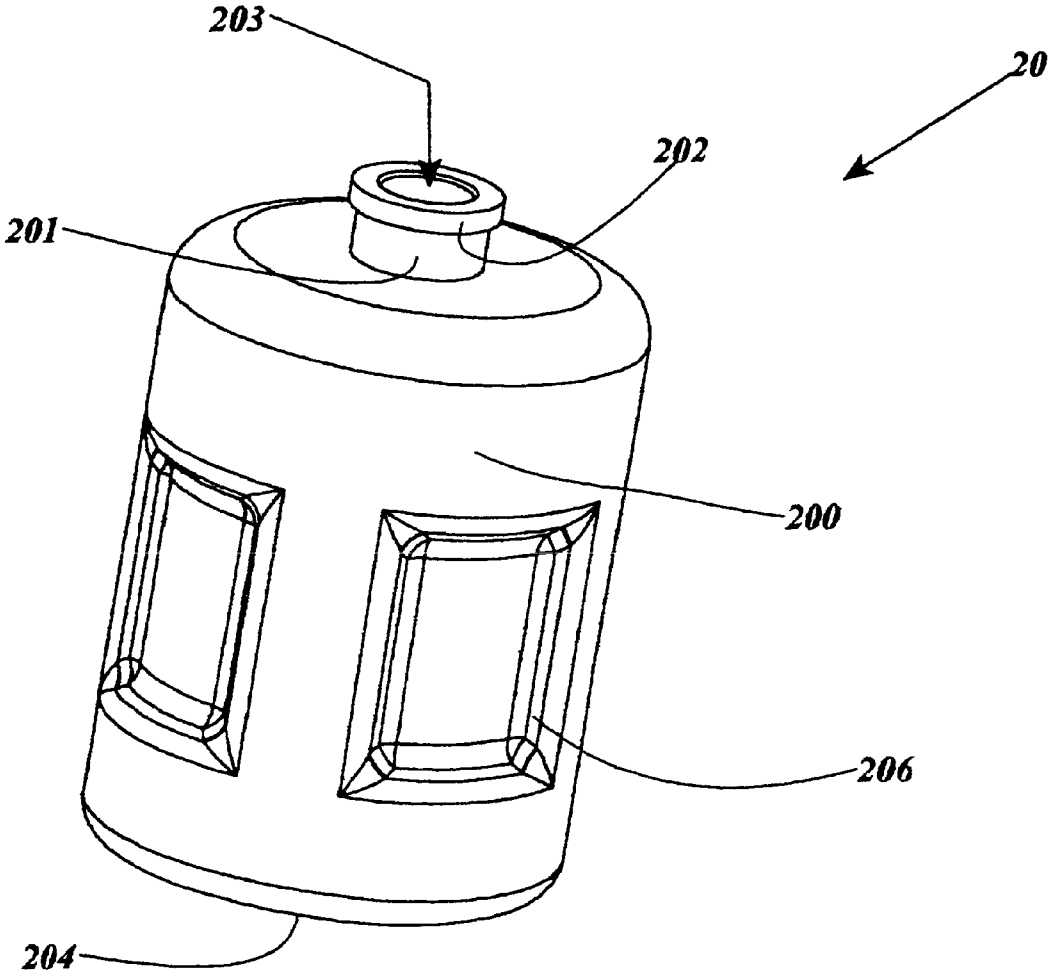
FIG. 4 shows one embodiment of the receptacle.
Figure 5:
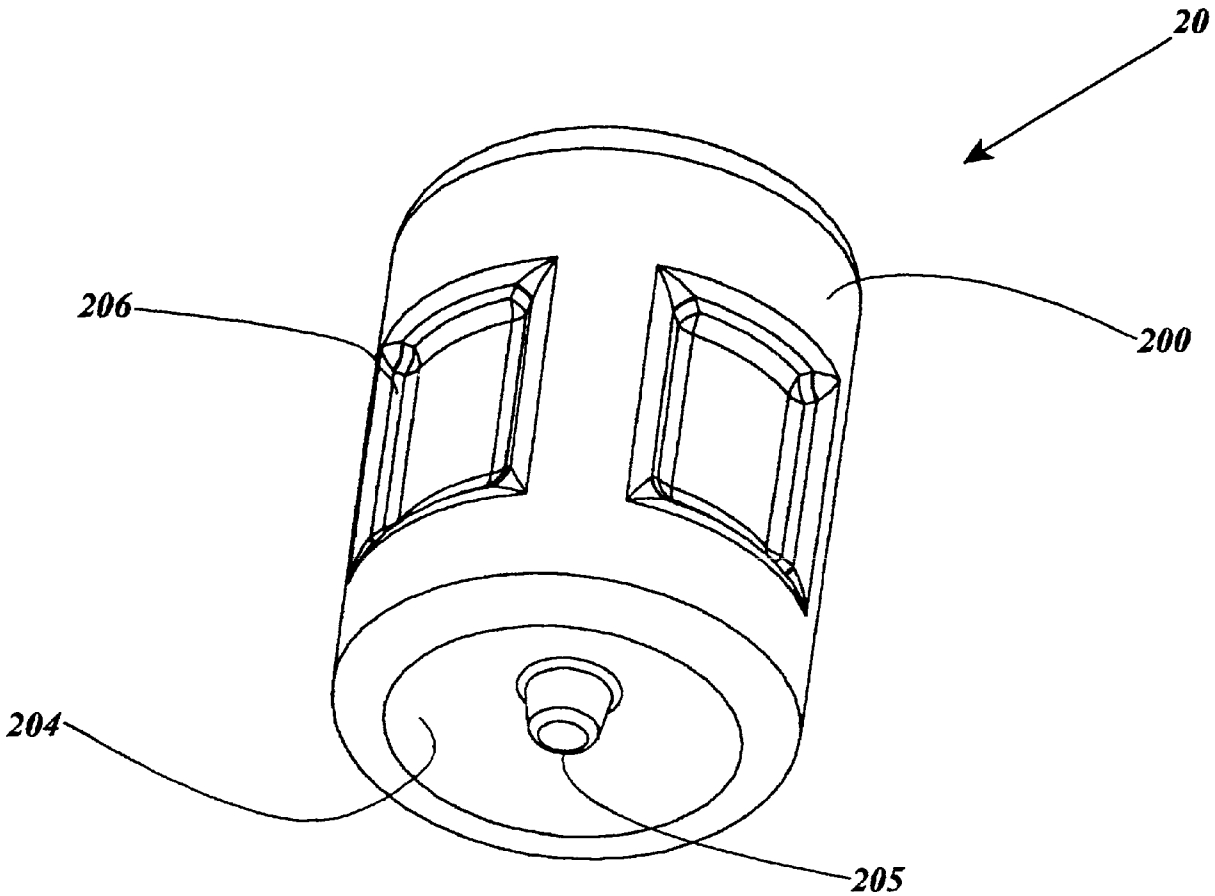
FIG. 5 shows the receptacle valve seat protruding from the bottom wall of the receptacle.
Figure 6:
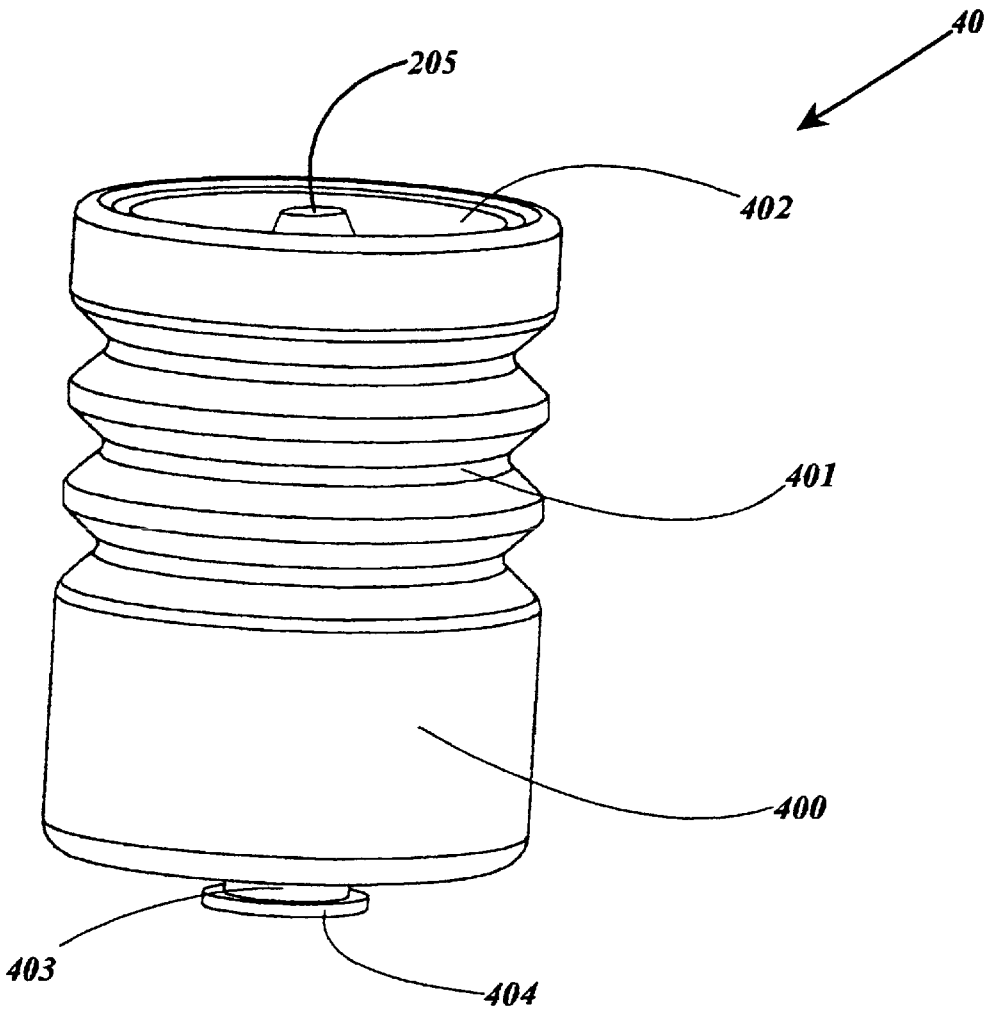
FIG. 6 shows another embodiment of the receptacle with a bellows type body for raising and lowering the receptacle valve seat unto the stem valve outer bottom edge, but with a simple flat bottom valve seat.
Figure 7:
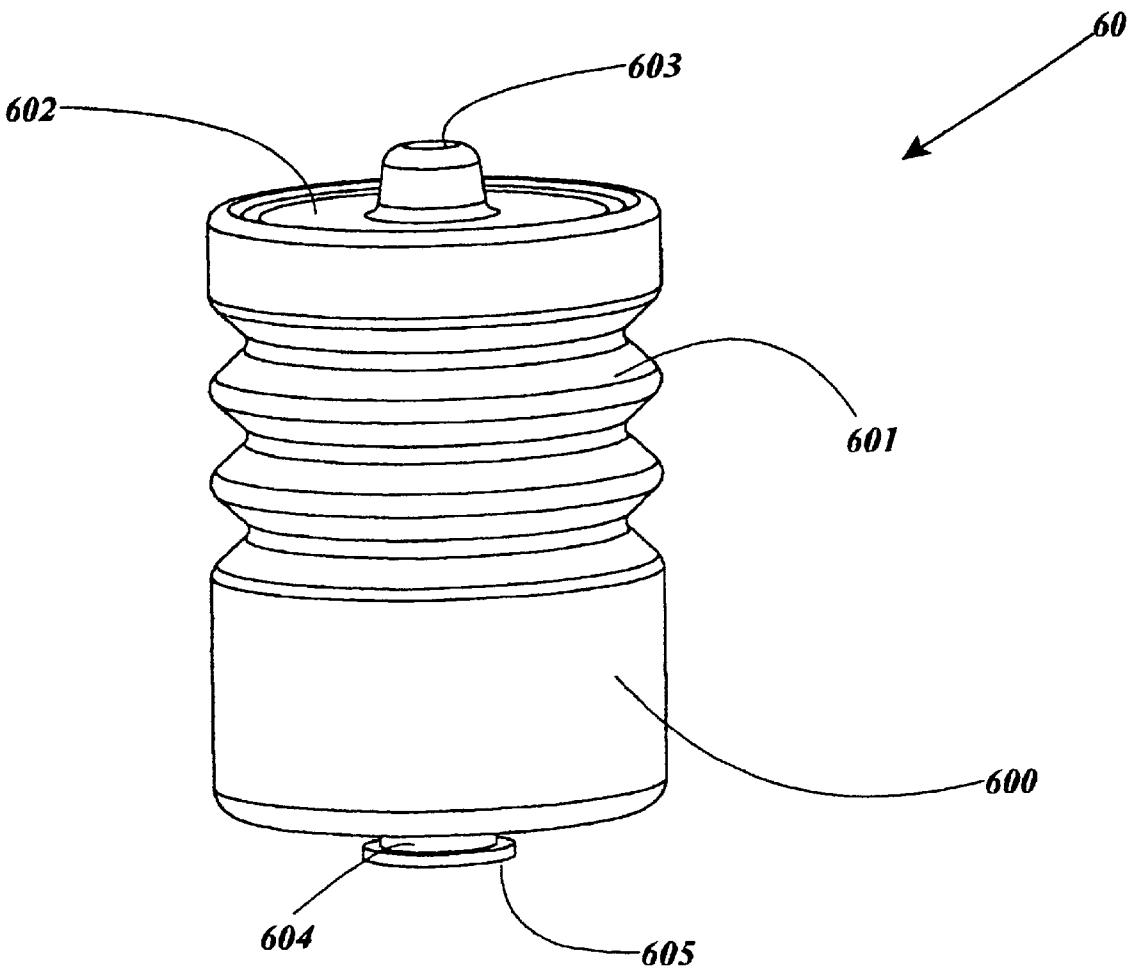
FIG. 7 shows the receptacle of the embodiment of FIG. 6 with a conical receptacle valve seat.
Figure 8:
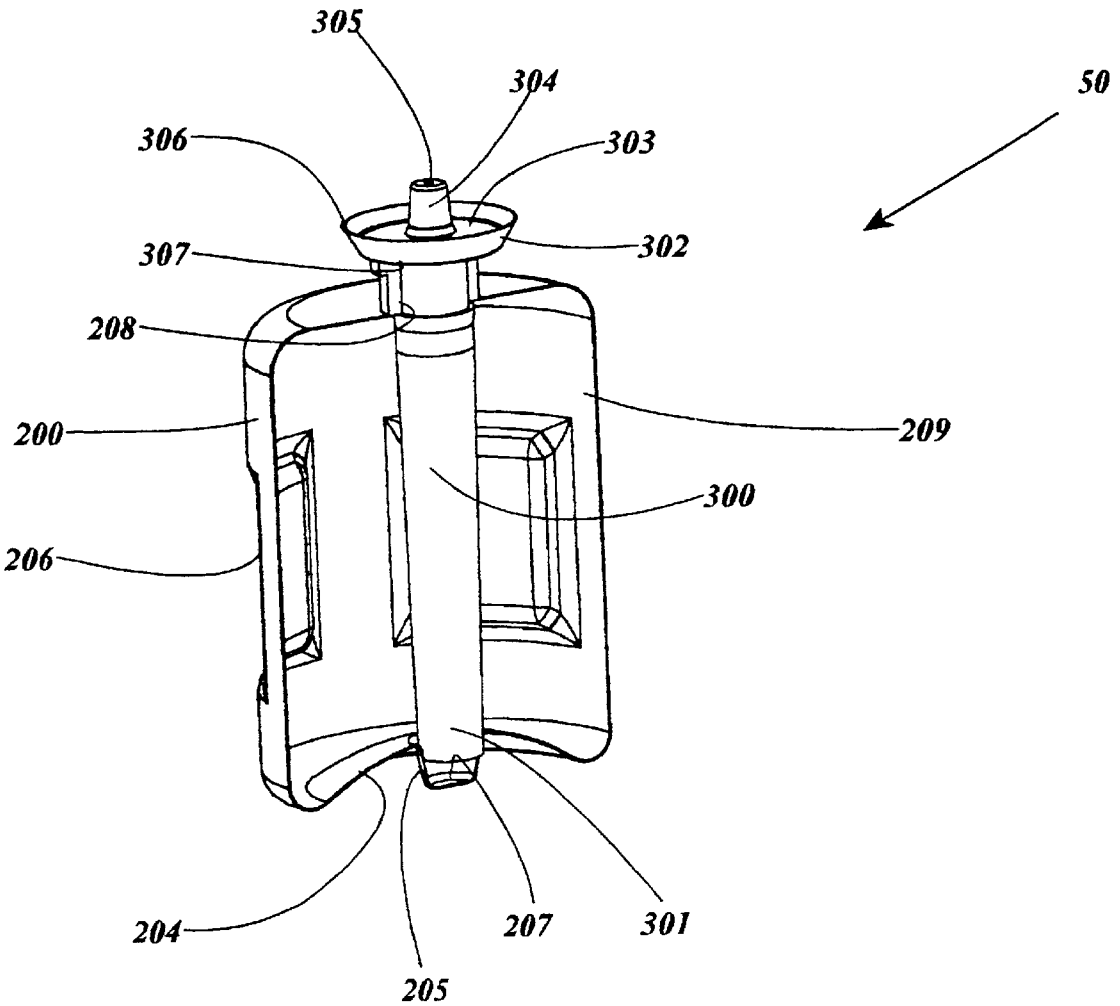
FIG. 8 shows a cut away view of the receptacle with the stem valve attached therein, and the stem valve outer bottom edge sealing on the receptacle valve seat, trapping water inside the receptacle.
Figure 9:
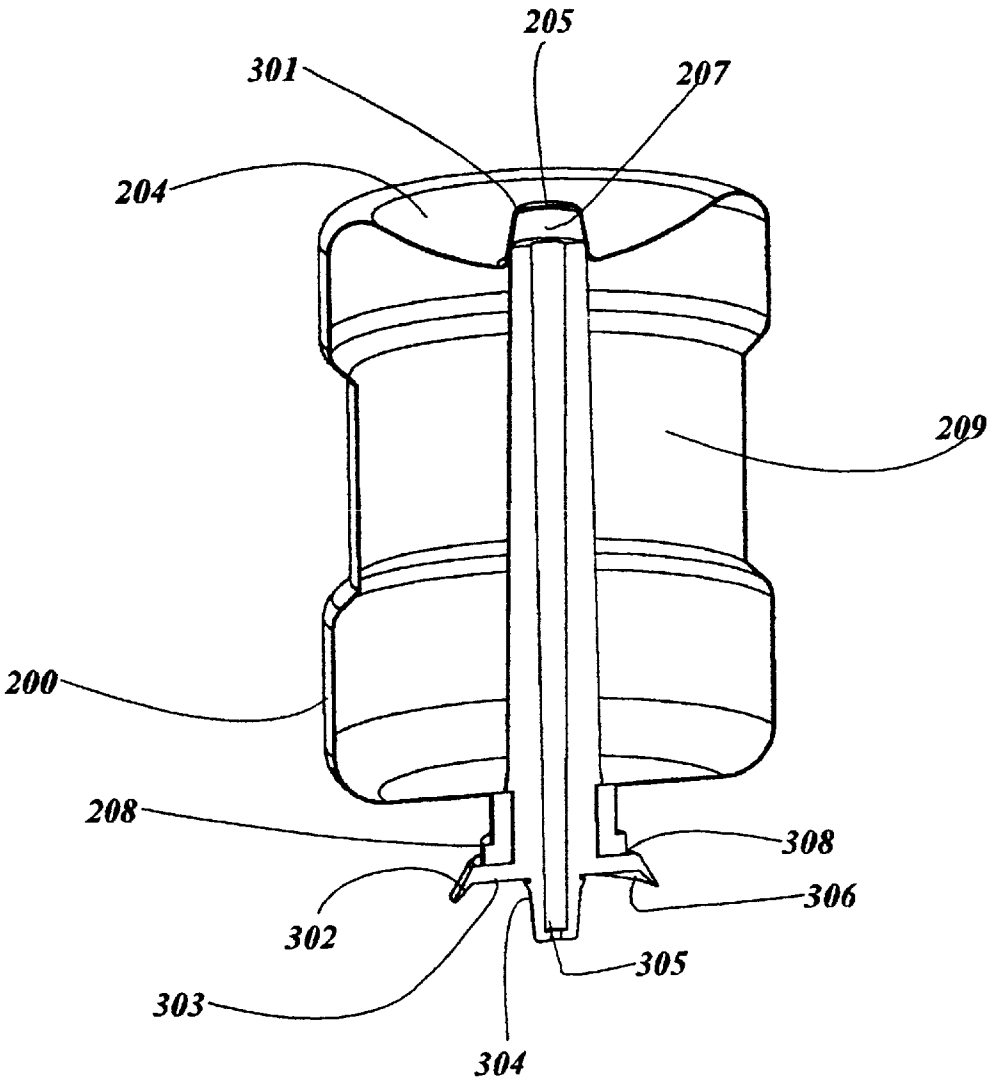
FIG. 9 shows the receptacle and stem valve assembly and the stem valve through hole.
Figure 10:
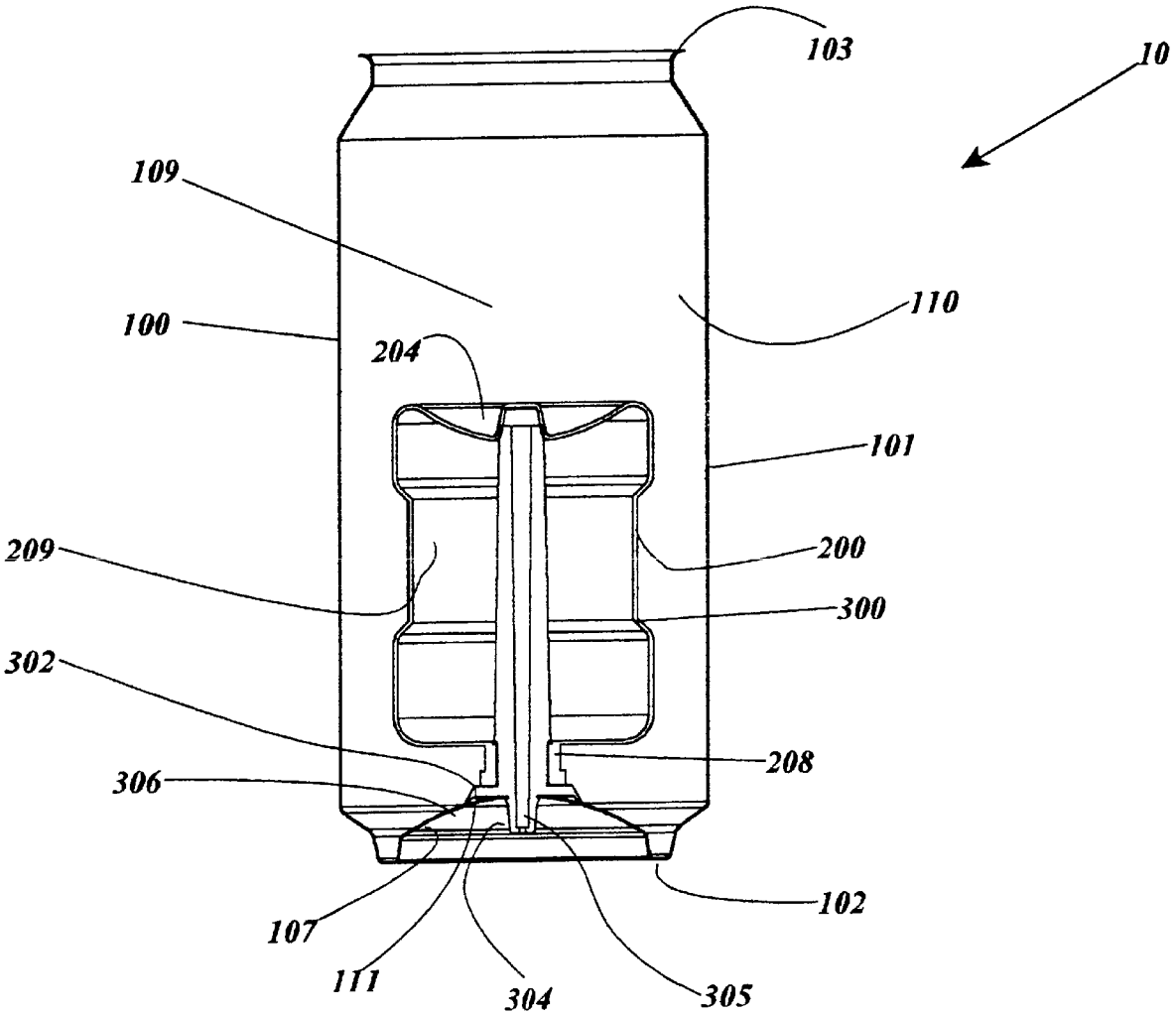
FIG. 10 shows a cut away view of the apparatus according to the preferred embodiment of the invention before the beverage is filled into the container, the receptacle is filled with water, and the stem valve attached by a snap to a hole through the container bottom wall.
Figure 11:
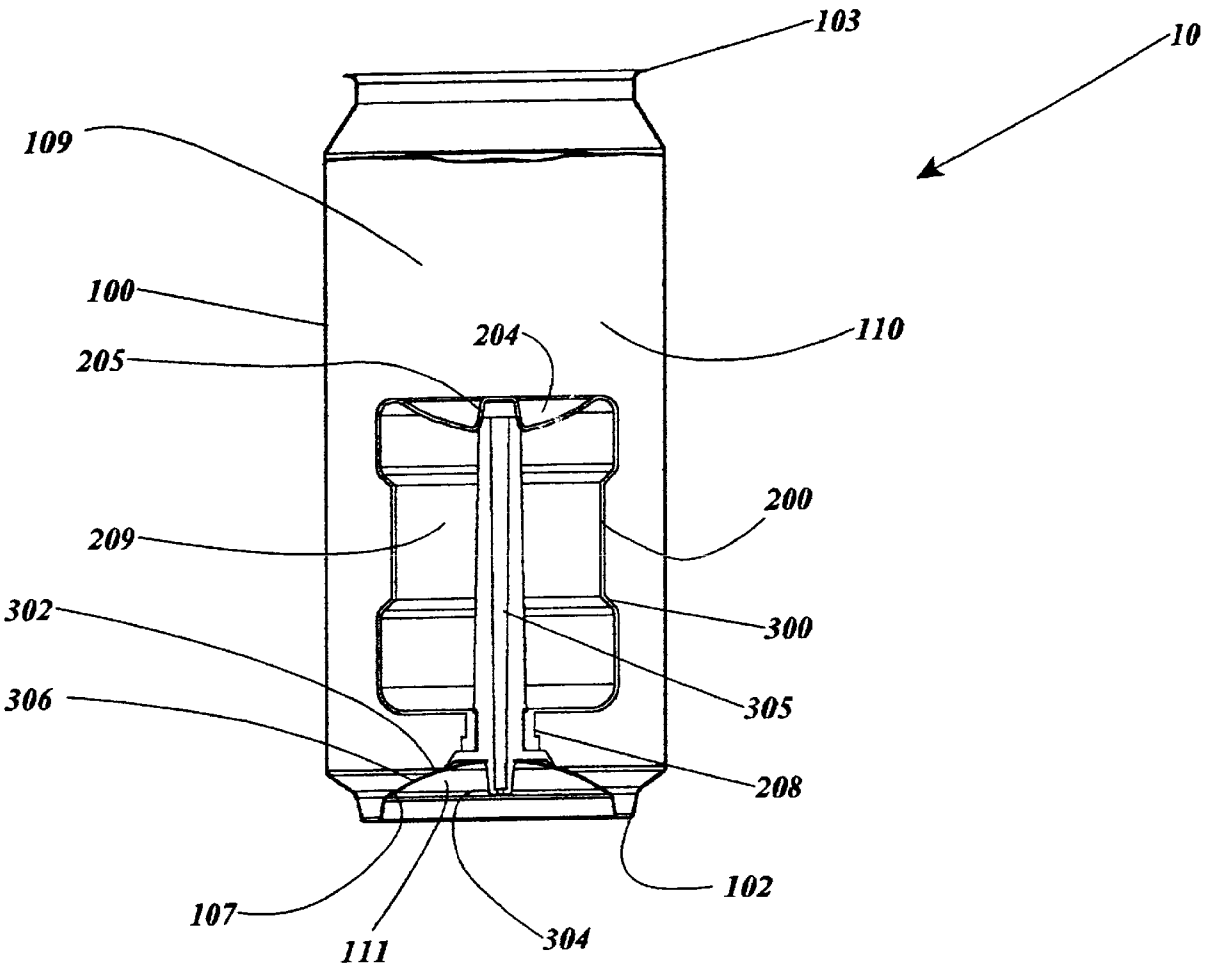
FIG. 11 shows a cut away view of the apparatus according to the preferred embodiment of the invention with beverage filled into the container and surrounding the receptacle walls, the receptacle filled with water, and the stem valve attached by a snap to a hole through the container bottom wall.
Figure 12:
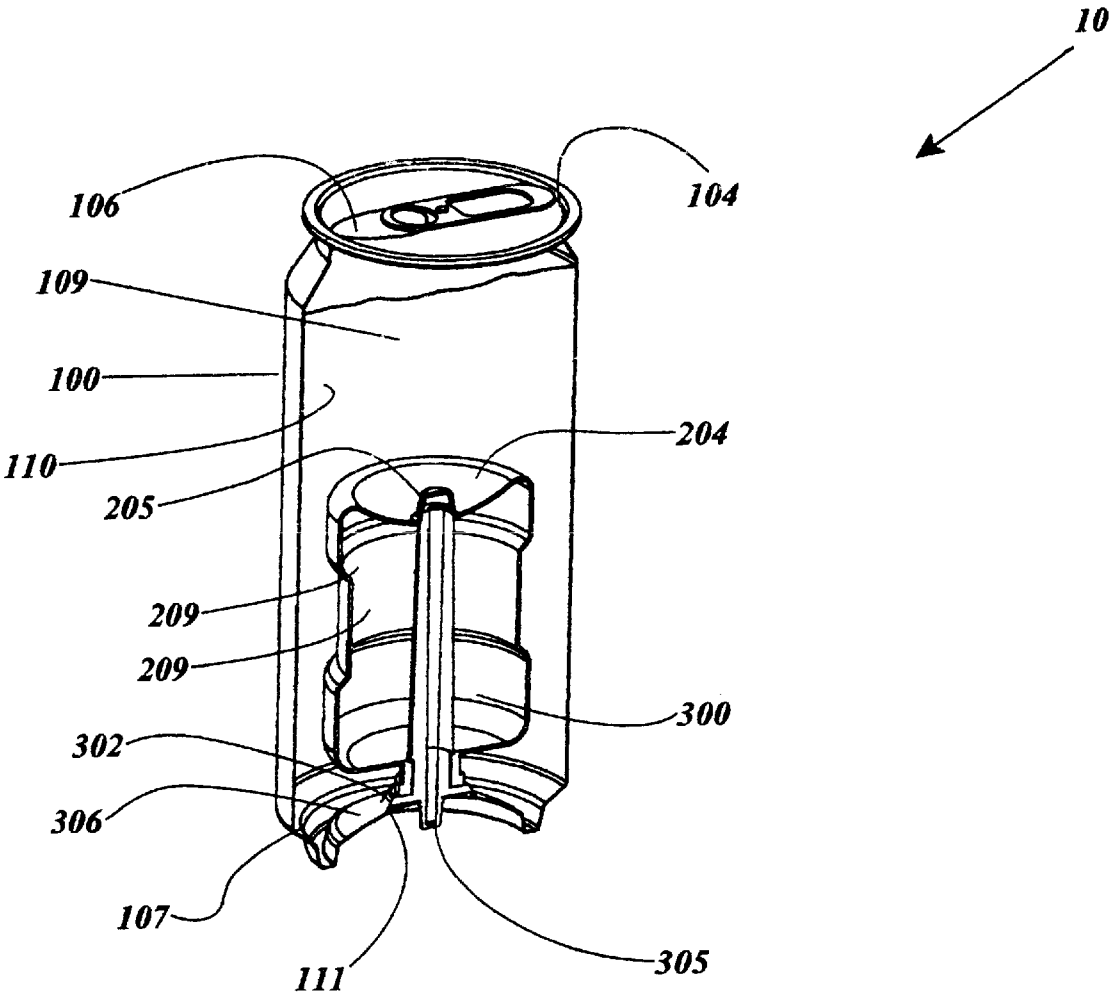
FIG. 12 shows the apparatus with the lid seamed unto the container to seal the beverage product and the receptacle inside the container.
Figure 13:
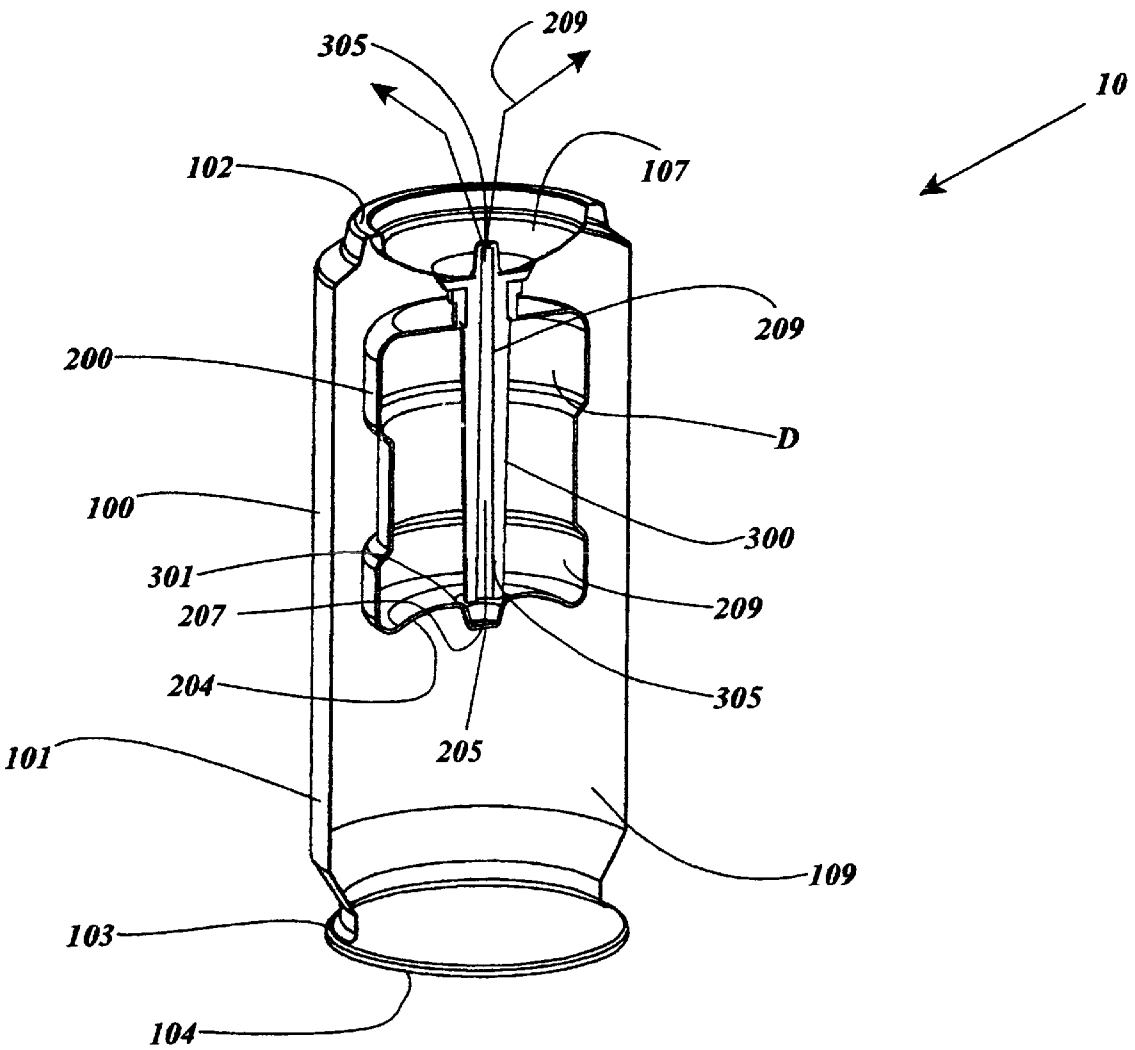
FIG. 13 shows the water in the receptacle being expelled by the pressure of the liquified dose refrigerant.
Figure 14:
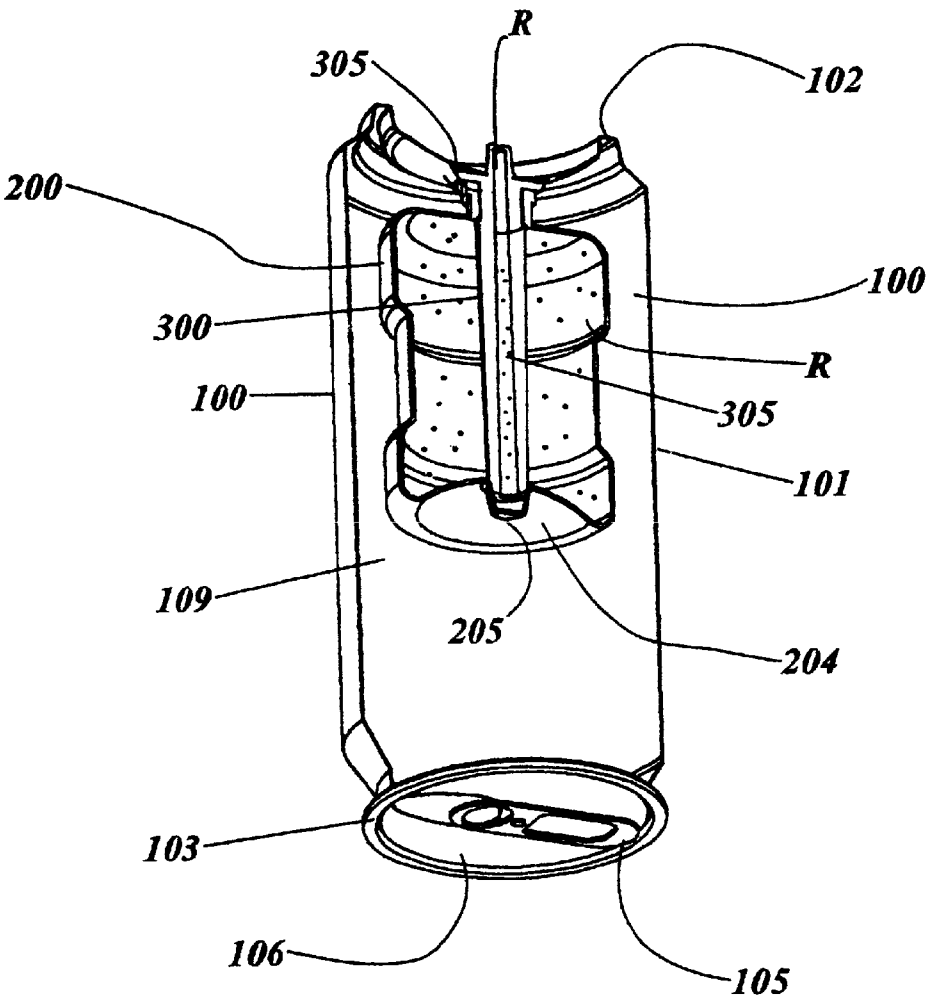
FIG. 14 shows the apparatus being charged with liquified refrigerant.
Figure 15:
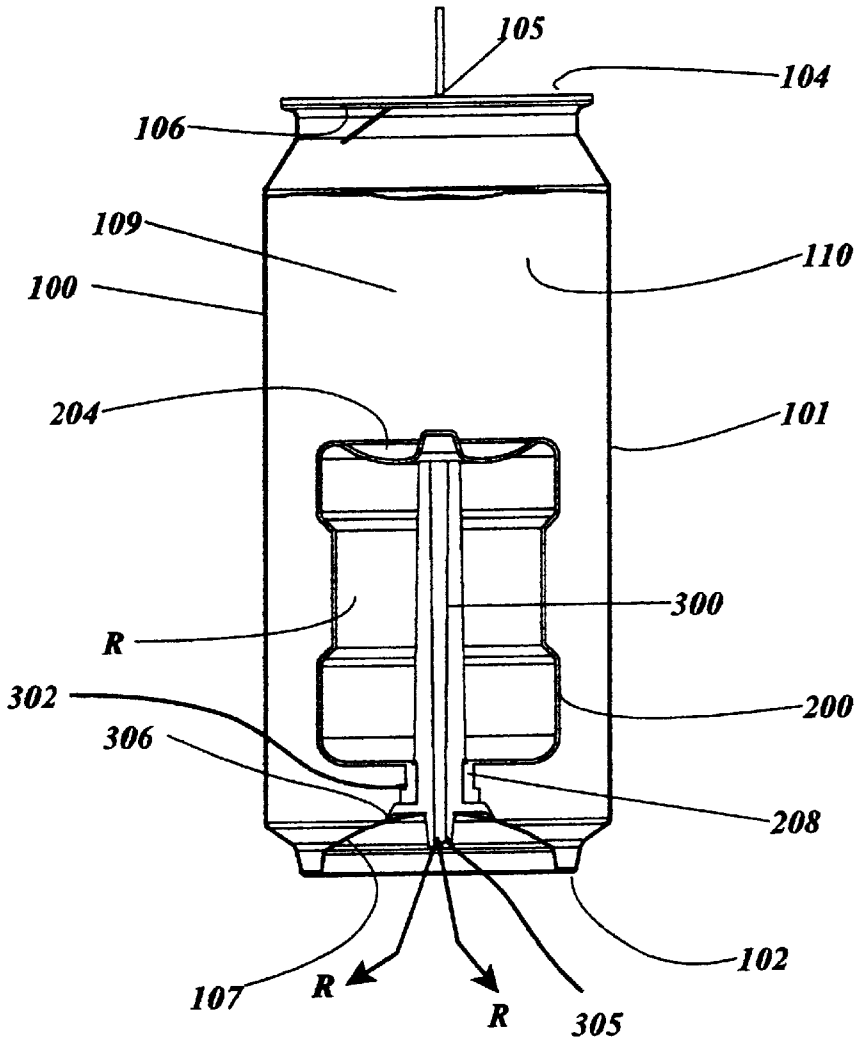
FIG. 15 shows the beverage container opening means opened to atmospheric pressure, and the receptacle valve seat dislodged from the stem valve outer bottom edge breaking the seal for the liquified gas to escape from the receptacle. The figure also shows that only the gaseous phase of the gas can escape when the container is opened.
Figure 16:
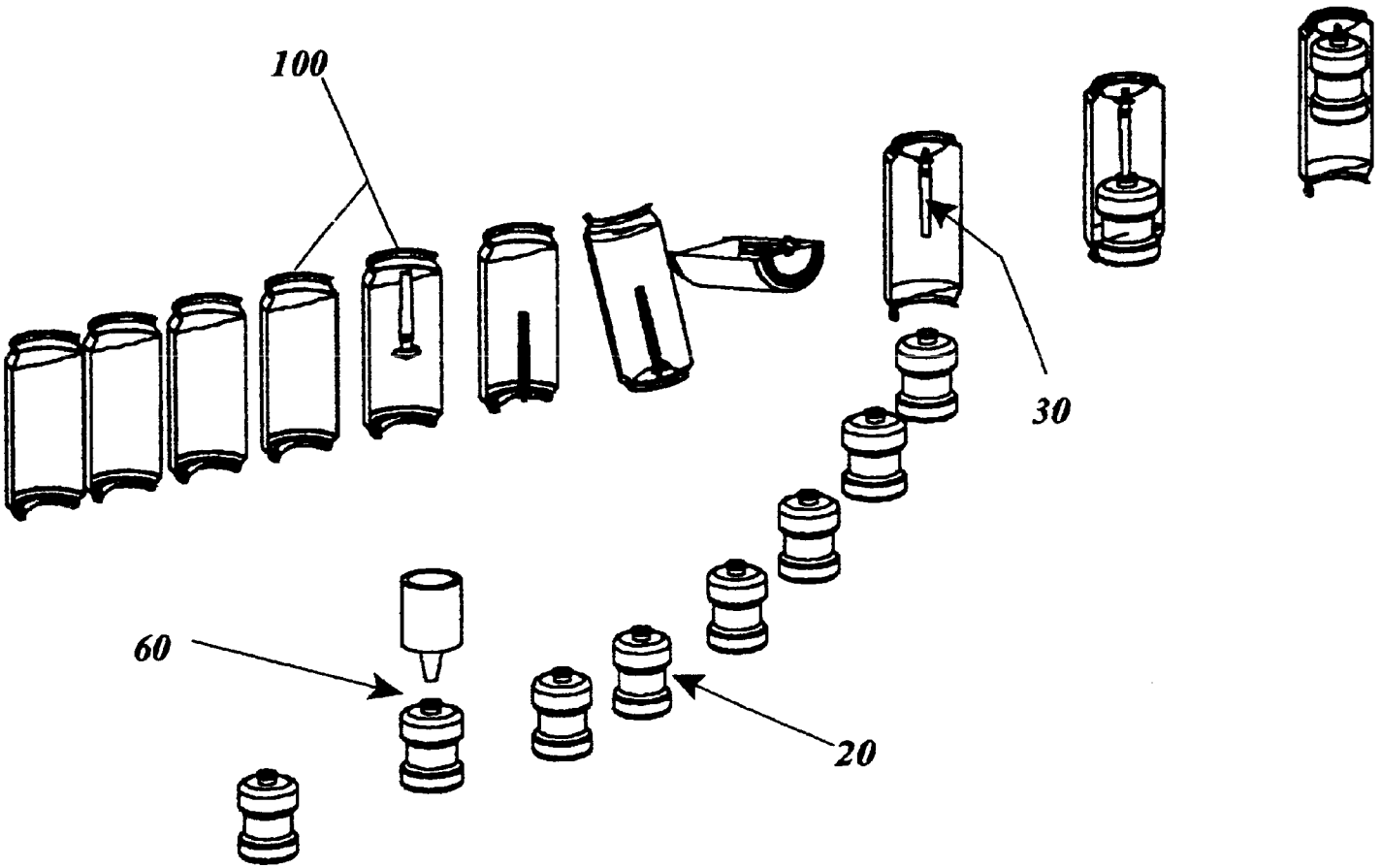
FIG. 16 shows a schematic of one embodiment of an assembly process for the apparatus, with water being poured into the receptacle and the stem valve attached to the beverage container, and then the receptacle being attached to the stem valve.
Figure 17:
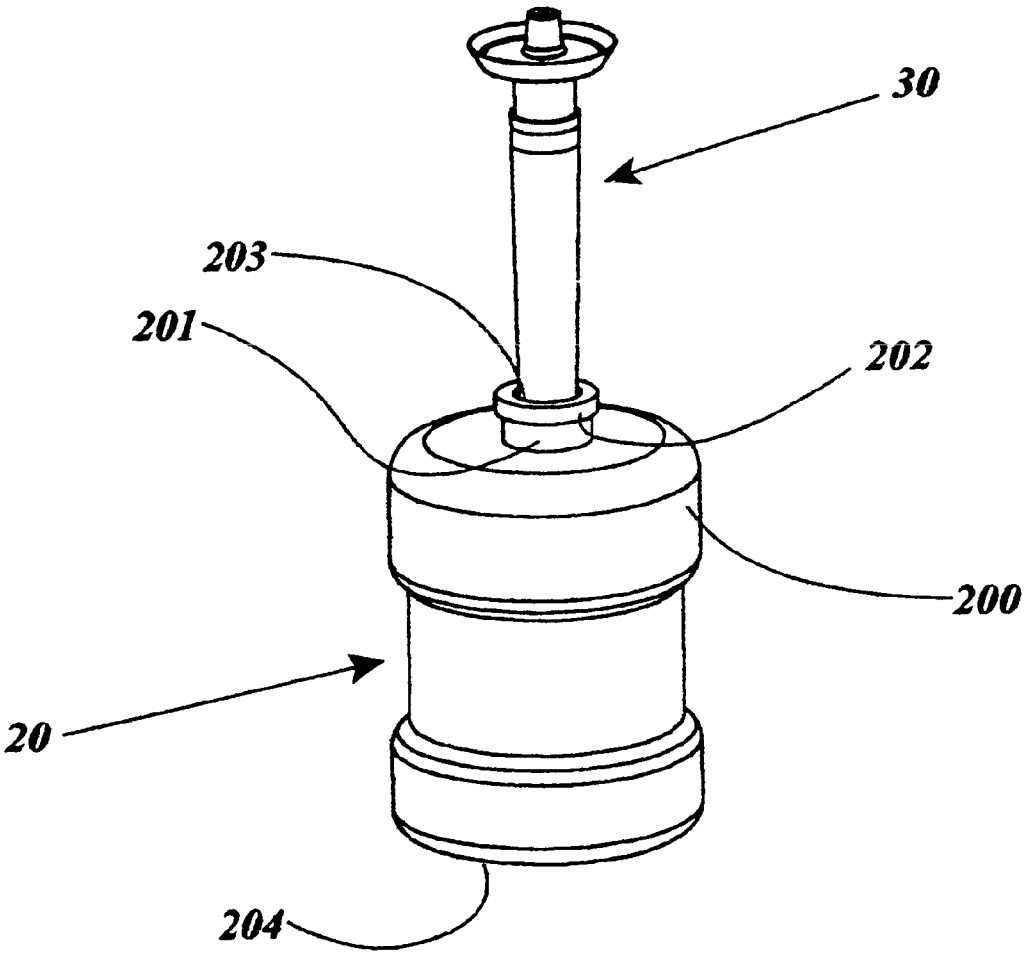
FIG. 17 shows the stem valve being inserted into the water filled receptacle, as an example of the assembly process during which the receptacle stem valve are first assemble before assembling the two with the beverage container.
Figure 18:
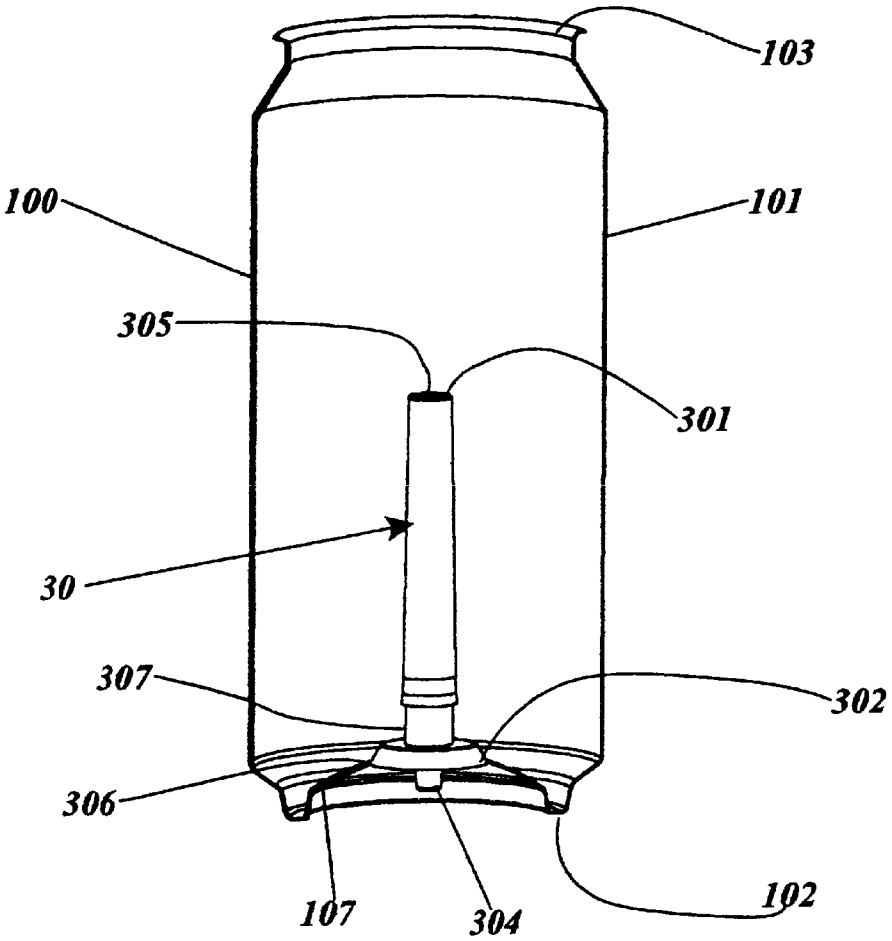
FIG. 18 shows the stem valve being assembled with the container bottom wall hole as an example of the assembly process during which the stem valve and the container are first assembled together before the water filled receptacle is assembled with the stem valve.
Figure 19:
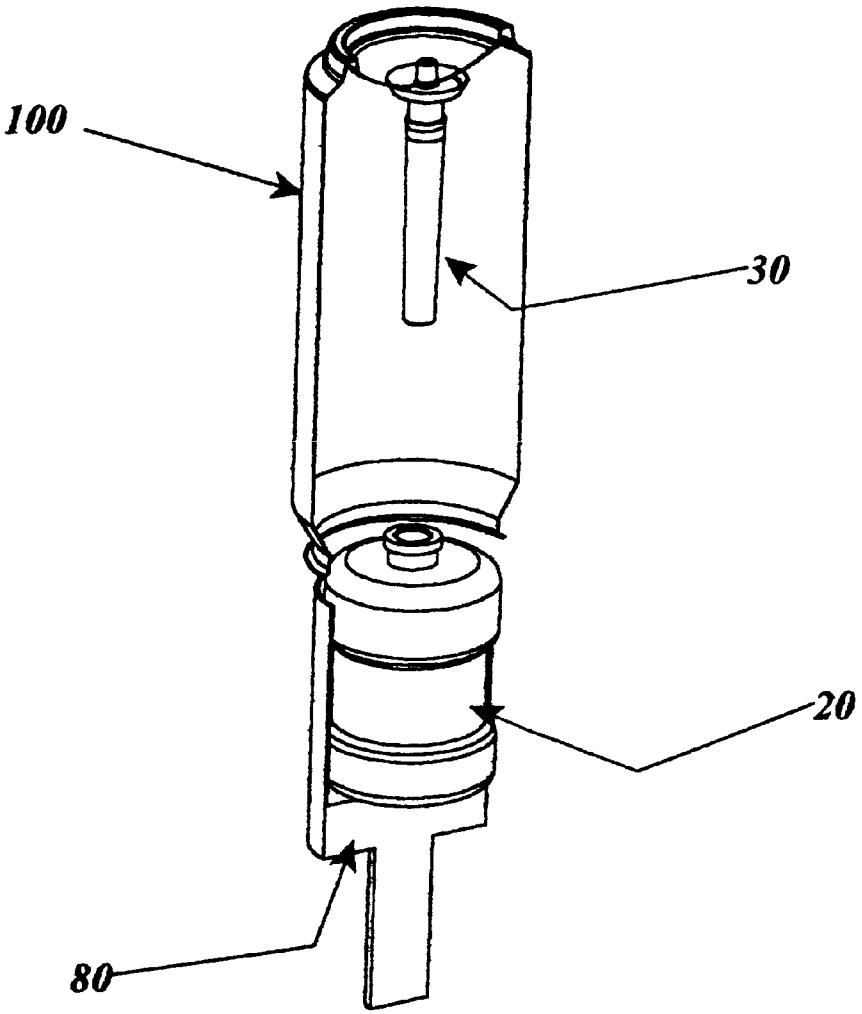
FIG. 19 shows a container with a valve stem attached and a rig for inserting the receptacle into the valve stem.
Figure 20:
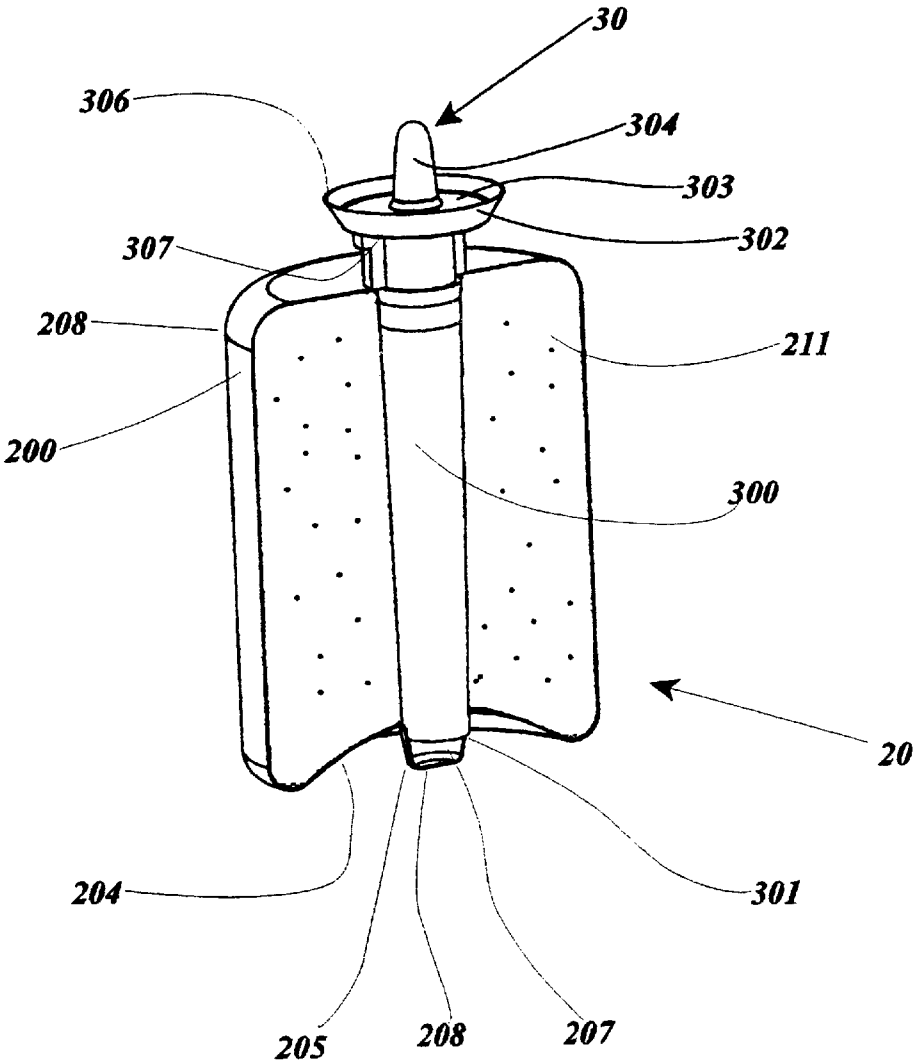
FIG. 20 shows a cut-away view of the receptacle according to the second embodiment with the refrigerant matrix filling the receptacle for assembly with the container and stem valve assembly.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, whenever the words liquified refrigerant are used, they also refer to refrigerant mixtures of an activated carbon matrix or Carbon Fullerine Nanotubes with a high pressure refrigerant such as $CO_2$, $N_2$, or other suitable gases.

Reference is now made to the drawings, wherein like characteristics and features of the present invention shown in the various FIGURES are designated by the same reference numerals.

Referring to FIGS. 1–20, a self cooling beverage container apparatus 10 is disclosed. In the first of the preferred of several possible embodiments, the apparatus 10 includes a conventional container 100 such as a metal or plastic can containing container contents 110 having a conventional unified domed container bottom wall 102, and a cylindrical container side wall 101 terminating in an upper container sealing rim 103. A container sealing lid 104 is also provided for sealing off the container contents 110 inside the container 100 with container sealing rim 103. A round container bottom wall hole 108 passes through the center of the domed container bottom wall 102.

The apparatus 10 further comprises a thin walled plastic or metal receptacle 20 with substantially the shape of a small plastic or metal bottle with a bottle neck. With the said receptacle 20 oriented so that it sits on a bottom wall 204 and with the open end facing an upwardly direction, the receptacle 20 comprises a substantially horizontal round top wall 210 from the center of which wall is joined a short smaller diameter cylindrical receptacle neck protrusion 201 which terminates with a thin receptacle open neck round flange 202. Said receptacle open neck flange 202 having a slightly larger diameter than the cylindrical receptacle open neck protrusion 201. The receptacle top wall 210 has a diameter that is greater than the diameter of the receptacle open neck protrusion 201. The top wall 210 and the receptacle open neck protrusion 201 form a continuous unified wall of the receptacle 20 with the receptacle open protrusion neck 201 forming a passage through the receptacle top wall 210 as an entry way for ingredients that are to be stored inside the receptacle 20. A receptacle side wall 200 sealingly joins the receptacle top wall 210 protruding in the downward direction to sealingly join a substantially round receptacle bottom wall 204. Thus, the receptacle 20 walls are all joined together to form continuous bottle with an open neck. The receptacle bottom wall 204 is designed to be slightly flexible and to flex up and down the axis of the receptacle 20, so as to increase the overall length of the receptacle 20 when the pressure acting inside the receptacle 20 walls is greater than the pressure acting outside the receptacle 20 walls. In general the walls of the receptacle 20 are flexible and thin relative to its size. The receptacle 20 is also designed to be handled easily for manufacturing the self-cooling container so that the processes that would be encountered during the manufacturing would be easily accomplished because of the way the receptacle 20 is designed and works. The receptacle 20 is also designed to store a liquified refrigerant R at a minimal pressure far less than the refrigerant R phase pressure by means of equilibration with carbonation beverage pressure, and when the refrigerant R pressure acting inside the receptacle 20 walls equilibrates with beverage pressure acting outside the receptacle 20 walls. The receptacle sealed bottom wall 204 is flexible. A substantially conical valve seat 205 protrudes outwardly in a downward direction from the center of the receptacle bottom wall 204 to form a valve seat 205. The inside surface of valve seat 205 forms a valve seat recess 207, which is designed to sealingly mate with the outer bottom edge 301 of a substantially tubular stem valve 30, so that liquified refrigerant R contained inside the receptacle 20 will not boil and escape from within the receptacle 20 when the force generated by the pressure acting outside walls of the receptacle 20 is greater than the pressure of the refrigerant R acting on the inside walls of the receptacle 20. Advantageously, the receptacle 20 valve seat recess 207 will not form a seal with the stem valve outer bottom edge 301 if the force due to pressure acting on outside of the receptacle 20 walls is less than the force due to the liquified refrigerant R pressure acting on inside walls of the receptacle 20. Conventional refrigerant storage systems simply store refrigerant in a phase equilibrium state so that the gas phase pressure is equal to the liquid phase pressure. However receptacle 20 is designed to store the liquified refrigerant R in a phase locked condition, so that the gaseous phase is at a pressure slightly higher than that required to liquify the refrigerant R at the temperature of the liquified refrigerant R. Advantageously, a higher packing fraction of liquified refrigerant R to receptacle 20 volume can be achieved by this invention. The expected maximum packing fraction is recorded by empirical studies, is about 90%.

The apparatus 10 further comprises a stem valve 30 for mating with and forming a valve seal with receptacle 20. The stem valve 30 is essentially a tubular valve that mates with receptacle 20. Stem valve 30 comprises a short cylindrical tube 308 of a length of about ½ inches and diameter ⅜ inch which protrudes from the bottom surface 307 of a sealing cup flange 302 and connects to a conical tube stem valve body 300 of a length of about 3 inches. Sealing cup flange 302 is shaped like a shallow suction cup of a diameter of approximately 1 inch and a depth of about ¼ inch, for sealing against container domed inside bottom wall 107 of the beverage container 100. The dimensions given are only for the sake of comparative clarity of the present invention, and should not be construed as the only possible dimensions for the parts of the apparatus 10. A short small cylindrical stud 304 protrudes from the inside surface of the sealing cup flange 303 in the opposite direction to the stem valve body 300. The approximate diameter of the stem valve stud 304 is ¼ inch, but it could be larger or smaller depending on the size of the beverage container 100 the apparatus 10 is designed for. A small stem valve hole 305 passes through the entire length of the stem valve 300. The stem valve hole 305 could be made larger inside the stem valve body 300, for reasons of ease of manufacturing. The approximate diameter of the stem valve hole 305 is about 0.04 inches. Again all of the dimensions sited are examples of one embodiment of the invention. The stem valve cylindrical stud 304 is designed to tightly push or snap into container bottom wall hole 108 to hold the receptacle 20 and stem valve 30 receptacle and valve assembly 50 centrally inside the beverage container 100. The sealing cup flange 302 forms a tight seal against the container domed inside bottom wall 107 of the beverage container 100 when the stem valve stud 304 is tightly pushed into the container bottom wall hole 108.

In yet another mode of assembling the apparatus 10, a first step is affixing the stem valve 30 to the receptacle 20 by passing the stem valve body 300 through the receptacle neck protrusion opening 203, so that the stem valve cylindrical body 308 seals against the inside surface 208 of the receptacle neck cylinder 201, and the bottom surface 307 of the stem valve sealing cup flange 302 sealingly mates to outer surface of the receptacle open neck flange 202. The stem valve 30 is designed to fit snugly and tightly into the receptacle neck protrusion opening 203, so that a gas tight plug is formed around the receptacle open neck flange 202. The stem valve 30 is made long enough so that when the bottom surface 307 of the sealing cup flange 302 mates with the receptacle open neck flange, the conical stem valve body 301 also sealingly abuts the surface of the receptacle valve seat recess 207. Thus, when the conical stem valve body outer bottom edge abuts the valve seat recess 207 of valve seat 205, pressurized refrigerant gas R cannot escape through the stem valve hole 305, or through the receptacle neck protrusion opening 203. Other methods of practicing the invention do not require that the conical stem valve body 301 outer bottom edge seal the surface of the receptacle valve seat recess 207 when the stem valve flange 302 is fully seated on the receptacle open neck flange 202. It is important that the conical stem valve body 301 outer bottom edge be close to or actually contact the inside surface 207 of the receptacle valve seat recess 207, so that if the pressure inside the receptacle 20 is less than the pressure outside the receptacle 20, the receptacle bottom wall 204 is deflected inwardly to make contact between the inner surface 207 of the receptacle valve seat recess 207 and the conical stem valve body 301 outer bottom edge to form a gas tight seal that traps any liquified or gaseous refrigerant inside the receptacle 20 from escaping to the outside through the stem valve hole 305.

To manufacture the apparatus 10, if receptacle 20 is blow molded, valve seat recess 207 is formed by causing the end of the blow pin of a conventional blow molding machine to plunge into molten plastic material that comprises the hot preform tube of the clamped by the mold jaws. This allows valve seat recess 207 to be cleanly formed without deformity. The receptacle 20 shape is then blown inside a mold to form its shape. The finished receptacle 20 is then treated by surface fluorinating its walls to seal its pores and make the receptacle 20 impervious to gases. Receptacle 20 is then first filled with clean water 209. The stem valves 30 are then inserted into the receptacle 20 through the receptacle is blow molded or formed by conventional processes, form the neck protrusion opening 203 to displace some water 209 and form a seal with the receptacle open neck flange 202 and the inside surface 207 of the receptacle valve seat recess 207. Thus the water 209 is trapped inside the receptacle 20 and cannot pass through the stem valve hole 305, or the receptacle protrusion neck opening 203. The receptacle and valve assembly 50 is then inserted into the beverage container 100, and the stem valve stud 304 is aligned and pushed through the container bottom wall hole 108. The stem valve stud 304 is made slightly larger than the container bottom wall hole 108, so that as the stem valve stud 304 pushes into the container bottom wall hole 108, the stem valve stud 304 forces the container bottom wall hole 108 rim 112 to deform around the rim 112 into a small conical ring 113 of the container 100 material protruding out of the container 100. This conical ring 113 of material forms a tight swage fitting that holds the stem valve stud 304 firmly in place on the container 100. A snap action may also be used for this attachment. The deforming of the container bottom wall hole 108 into a substantially conical rimed hole 114, causes the container wall material to bight into the softer stem valve stud 304 material and form a hematic seal, and a very tight strangle hold on the valve stud 304. The stem valve 30 is pushed into the container bottom hole 108 until the stem valve sealing cup 302 flange makes a tight cup seal between the stem valve 30 and the container domed inside bottom wall 107. Thus, container bottom wall hole 108 deforms to a substantially conical rimmed hole 114 holding the receptacle and valve assembly 50 in place inside container 100. The apparatus 10 is then transported to a beverage filling plant, where the apparatus 10 is filled with container contents 110 under carbonation pressure in the annular space formed by the boundary of receptacle and valve assembly 50 and the inside of container 100. The sealing cup flange 302 has a cup wall 306 that seals against the domed surface of the container domed inside bottom wall 107.

During the beverage filling process, a filler head is sealed against the beverage container sealing rim 103. Nitrogen or carbonation pressure is transmitted from the beverage filler head to the inside space 109 of the beverage container 100. This pressure is also fully transmitted to the receptacle 20 outer walls. The pressure within the receptacle 20 builds up and equilibrates with the pressure of the carbonation gas inside the beverage container 100. The pressure outside the receptacle 20 causes the receptacle bottom wall 204 to deform slightly, pushing against the trapped water 209 in the receptacle 20 until the receptacle valve seat recess 207 inside surface 207 seals tightly against the outer bottom edge 301 of the conical stem valve body 301. This stops any water 209 from escaping from the receptacle 20. Since the receptacle 20 is now filled with only water 209, and water 209 is essentially incompressible, minimal deformation of the receptacle 20 walls occurs preventing any damage to the thin receptacle 20 walls. The pressurization of the container 100 with carbon-dioxide gas is important when carbonated container contents 110 is being filled to ensure that the carbonation of the container contents 110 occurs during the filling process. The container contents 110 itself is usually carbonated when it enters the container 100, where, because of the absorption of pressurized carbon-dioxide gas, it becomes highly carbonated. For a container 100 without the receptacle 20, the container 100 column strength is obtained by the filler head firmly forming a seal with the empty open container sealing rim 103 and pressurizing the container 100 directly with a blast of carbon-dioxide gas. The column strength of the container 100 is obtained by the internal pressure of the container 100. This allows the filler head to firmly seal the container sealing rim 103 to maintain the pressure of the container contents 110 during the filling process. Thus it is important that the above steps be taken in manufacturing a useful self-cooling beverage container. Absence of water 209 could cause the receptacle 20 walls to collapse and prevent column strength from building up, thus causing the container 100 to collapse under the filler head forces. Thus, during filling, the receptacle 20 advantageously transmits the filler head forces directly to the water 209 without subjecting the container 100 walls or the receptacle 20 walls to deformation stresses.

The method of manufacture of the receptacle 20 generally involves the broad steps of injection molding preforms from suitable plastic materials; blow molding the receptacle 20 to a shape of particular form; orienting the receptacle 20 for filling with water 209; inserting the stem valve 30 into the receptacle 20; and insertion the receptacle and valve assembly 50 into beverage containers 100 so that the stem valve stud 304 is pushed to a tight fit into the container bottom wall hole 108; filling the beverage container 100 with container contents 110; seaming the container lid 104 onto the container sealing rim 103; checking for carbonation column strength of the filled and seamed container 100. The steps further comprise; the broad steps of ejecting the water 209 in the receptacle 20 by pressure feeding a small dose of higher liquified refrigerant D into the receptacle 20 through the stem valve hole 305; said refrigerant D opening the seal made between the inside surface 207 of the valve seat recess 207 and the outer bottom edge of the conical stem valve body 301; using a high pressure piston charger to charge liquified refrigerant D through the stem valve hole 305 into the receptacle 20; storing the apparatus 10 for later sale or use by a consumer.

It is important to know that the liquified phase of the refrigerant R to be used for cooling may be either at a lower or higher pressure than the carbonation pressure $P_B$ of container contents 110. This is so because the force generated by the pressure $P_B$ of container contents 110 acting on the outside walls of receptacle 20 must always be able to overcome the force generated by the pressure $P_R$ of refrigerant R acting on the inside surfaces of the receptacle 20 walls in order to force the inside surface 207 of the receptacle valve seat recess 207 to form a seal with the conical stem valve body 301 outer bottom edge and trap refrigerant R during storage. Also, as the pressure $P_B$ of container contents 110 inside container 100 builds up, the pressure $P_B$ compresses the receptacle bottom wall 204 and forces the receptacle bottom 204 wall to bow inward into receptacle 20. This forces the valve seat recess 207 to mate with stem valve outer bottom edge 301. Thus, the net projected surface area of the receptacle bottom that is exposed to the refrigerant R pressure $P_R$ is equal to the area of the receptacle bottom wall 204 minus the area of the inside surface 207 of the valve seat recess 207. This are is always less than the outer surface area of receptacle bottom wall 204 that is exposed to the carbonation pressure $P_B$ of container contents 110. This difference in areas is equal to the amount of the surface area trapped between the inside surface 207 of the receptacle valve seat recess 207 and the conical stem valve outerbottom edge 301. Thus by adjusting this area, the refrigerant R pressure $P_R$ may be made to always exert a force on the receptacle bottom wall 204 that is less than force exerted by the pressure $P_B$ of container contents 110 on said receptacle bottom wall. Thus, advantageously, the inside surface of valve seat recess 207 and conical stem valve body 301 outer bottom edge will forcibly mate by this pressure difference and seal off the stem valve hole 305 from the refrigerant R completely so that no refrigerant R can escape from the inside of receptacle 20 to atmosphere. During the storage of the unit, this force difference is used to trap refrigerant R in a liquid phase-locked state with little or no gaseous phase in receptacle 20. This is a very efficient way for storing a liquified gas. As stated earlier, if careful calculations are done, it is possible to have the refrigerant R pressure equal or greater than the carbonation pressure by adjusting the amount of trapped surface area between the valve seat recess 207 and the valve stem outer bottom edge 301. This makes it possible to use other suitable refrigerants of a wider pressure range relative to the product pressure, $P_B$. The difference in pressure can be estimated by the following formula:

$$P_R \leq \frac{(P_B - P_S)D^2}{(D^2 - d^2)}$$

where $P_R$ is the maximum pressure of the refrigerant R to be used, $P_B$ is the pressure of the carbonated beverage, and $P_S$ is the security difference in pressure to be used for the sealing of the refrigerant R during storage, and D is the diameter of the bottom receptacle wall 204, and d is the diameter of the outer bottom edge of the conical stem valve body 301. $P_S$ is nominally found to be about 5 psi under normal temperature conditions during summer in the State of Florida, USA. In other ambient conditions, the value of $P_S$ will depend on the variability of the carbonation pressure and the refrigerant R pressure with ambient conditions, particularly, temperature.

Thus by adjusting the values of d and D in any given design, the refrigerant R pressure $P_R$ could be determined for any given stem valve 30 and receptacle 20 dimensions d and D and given beverage 110 pressure $P_B$. This offers a great variability in the possible types of refrigerant R that could be used for cooling the beverage 110, and a variety of embodiments could be constructed.

Since by design the carbonation beverage pressure $P_B$ will always form a seal for the refrigerant R in the receptacle 20, the removal of the trapped water 209 in the receptacle 20 is a little demanding. This is achieved by using a higher pressure liquid dose refrigerant D other than the refrigerant R to be stored in the receptacle 20. This small liquid dose of refrigerant D must always produce a force that tends to open the valve seal.

This can be achieved if the pressure $P_D$, of the liquid dose refrigerant D, follows the relation, $$P_D > \frac{(P_B + P_S)D^2}{(D^2 - d^2)}.$$

For example if the carbonation pressure $P_B$=50 psi, and if D=1.86, d=0.25, with a safety pressure lock of $P_S$=5 psi, the refrigerant R pressure must be given by, $$P_R \leq \frac{(50-5)1.86^2}{(1.86^2 - .25^2)} = 45.83psi$$

and the liquid dose refrigerant D pressure required to evacuate the water 209 from the receptacle 20 must be greater than $$P_D > \frac{(50+5)1.86^2}{(1.86^2 - .25^2)} = 56.01psi$$

With the liquid dose refrigerant D pressure higher than the refrigerant R pressure, carbonation pressure, the liquid dose refrigerant D is able to maintain the stem valve 30 and the receptacle valve seat recess 207 in a relatively open state until all the water 209 and liquid dose refrigerant D has escaped from the receptacle 20. Some liquid dose refrigerant D in a gaseous form will remain in the receptacle 20 to keep the receptacle 20 walls from collapsing under carbonation pressure.

Upon complete or almost complete removal of the water 209 from the receptacle 20, the remaining liquid dose refrigerant D will be in gaseous form at pressure $P_D$ and will equilibrate with the beverage pressure $P_B$. The liquified refrigerant R that is to be stored in the receptacle 20 is then injected through the stem valve hole 305 into the receptacle 20 by a pressure assist piston pump in a liquified state into the receptacle 20. This has the advantage of completely filling the receptacle 20 with liquified refrigerant R without deforming the receptacle 20 walls. Upon completion of the charging, carbonation pressure $P_B$ immediately overcomes the refrigerant R pressure $P_R$ acting on the receptacle bottom wall 204 and pushes valve seat 205 to reseat the valve seat recess 207 against the conical stem valve body outer bottom edge 301, trapping the liquified refrigerant R inside the receptacle 20. Thus the container 100 is now filled with the beverage 110, and the beverage 110 surrounds the receptacle 20 which has the cooling refrigerant R within it. The completed assembly apparatus 10 is then stored or shipped to a customer for consumption.

The process of activation involves simply opening the container lid opening means 105 for consumption, so that the carbonation beverage pressure $P_B$ falls to atmospheric pressure, and the pressure of the liquified refrigerant R, $P_R$ acting on the internal walls of the receptacle 20 causes the receptacle bottom wall 204 to expand outwards pushing valve seat 205 away from the conical stem valve body outer bottom edge 301, and breaking the refrigerant R seal between valve seat recess 207 and the stem valve outer bottom edge 301. Since the conical stem valve body outer bottom edge 301 is above the liquid level of the refrigerant R when the container 100 is in the upright position, only refrigerant gas R is released through the bottom of the container 100 through the stem valve hole 305. This also has the advantage of preventing liquified refrigerant R from exiting the container 100 and causing freeze burns, since the container 100 contents will spill if the container 100 is tilted from the upright position.

To operate the present invention for use as a self-cooling container, no additional activation means is provided other than the beverage container lid opening means 105. Thus a consumer does not have the opportunity to tamper with the unit unless the consumer intends to open the beverage container 100 for consumption. The opening of the beverage container 100 for consumption simultaneously opens the receptacle valve 205 and refrigerant R mixture is progressively discharged in a gaseous phase from the receptacle 20 through the stem valve hole 305 as it extracts heat from the beverage 110 and evaporates. A process of manufacturing the above-described self-cooling container apparatus 10 for retaining container contents 110 is provided, including the steps of orienting the stem valves 30 for insertion into the receptacles 20; filling the receptacles 20 with water 209; inserting the stem valves 30 into the receptacles 20; and inserting the assemblies 50 into beverage containers 100; filling each beverage container 100 with beverage 110; seaming or crimping the container lid 104 onto the container 100; then piston pumping a high pressure liquified refrigerant dose D into the receptacle 20 to exhaust the water 209 from the receptacle 20; then piston pumping liquified refrigerant R into the receptacle 20 for storage of said refrigerant R for later use as a cooling agent.

Figure 21:
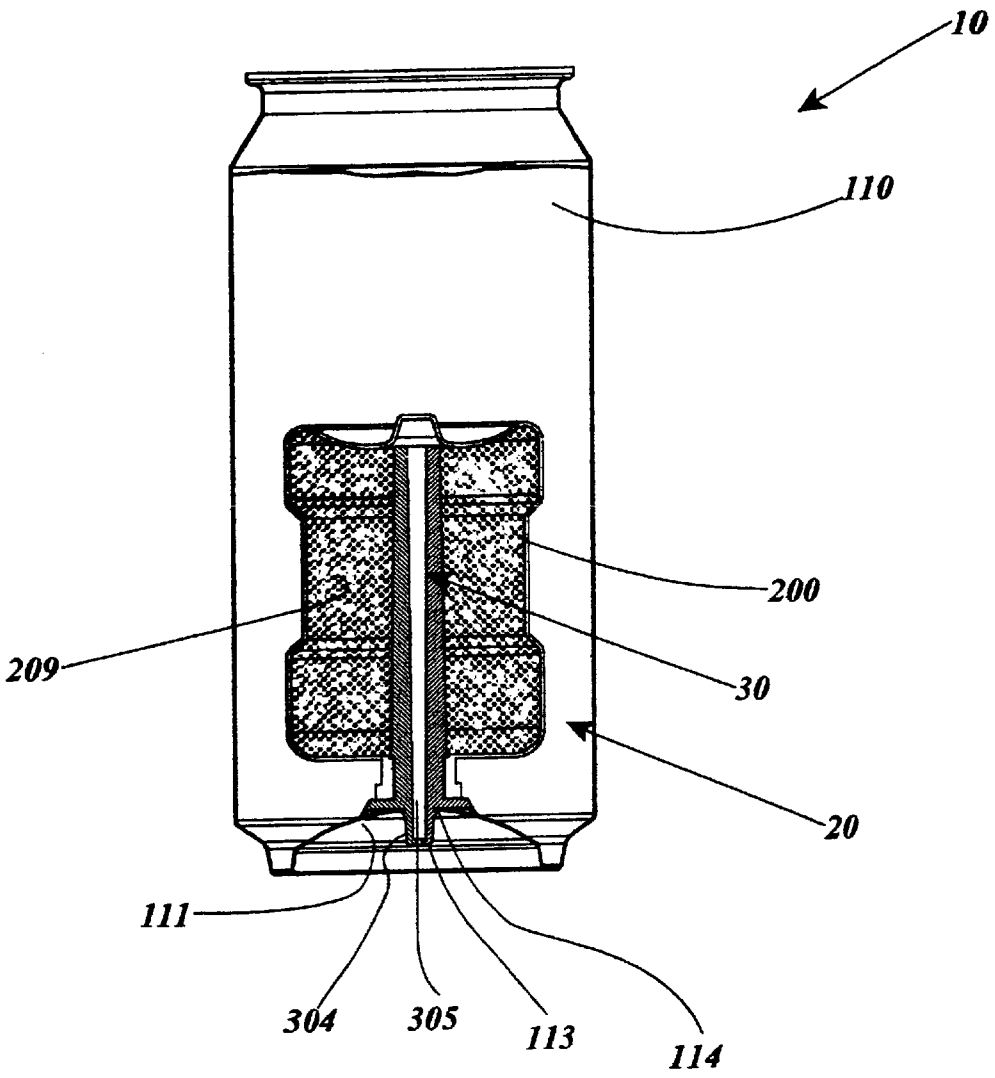
FIG. 21 shows a cut-away view of the receptacle according to the second embodiment with the salt crystal matrix filling the receptacle for assembly with the container and stem valve assembly, and the valve seat hole for communication of the container contents with the salt crystal.
Figure 22:
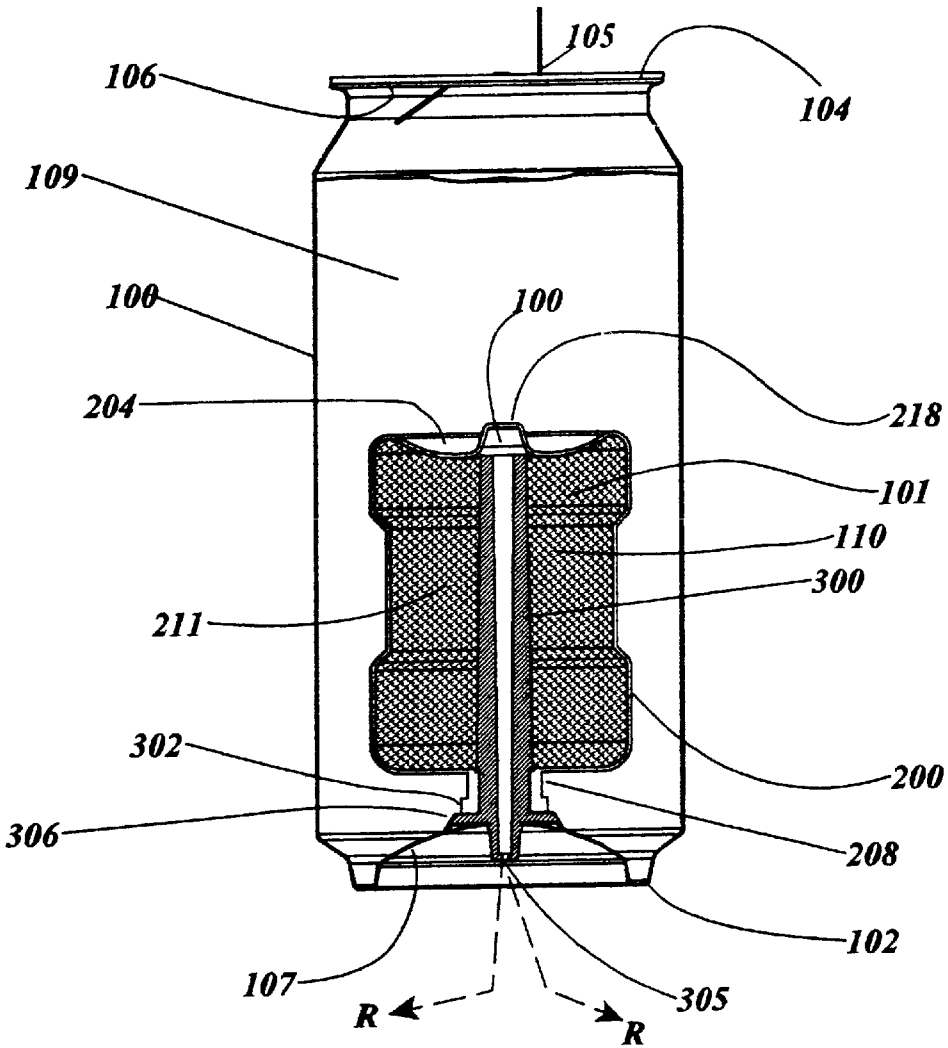
FIG. 22 shows a cut-away view of the receptacle according to the second embodiment with the salt crystal matrix filling the receptacle being saturated with water based container contents for achieving an endothermic reaction.

In yet a second embodiment of the invention, a water soluble salt 211 is used as a refrigerant medium A when mixed with water. In this embodiment, the receptacle 20 has a valve seat hole 218 through the center of the receptacle valve seat recess 207. This configuration is shown in FIG. 21 and FIG. 22. This valve seat hole 218 allows fluid communication between the inside of the receptacle 20 and the container contents 110 which generally contains water as part of its recipe, when the pressure inside the receptacle 20 is greater than the container contents 110 pressure. When the apparatus is assembled and the valve stem 30 bottom edge 301 mates with valve seat recess 207, no fluid communication exists between the inside of receptacle 20 and the atmosphere, or the inside of the receptacle 20 and the container contents 110. In this embodiment, valve seat recess 207 is made to be initially tightly seated with stem valve outer bottom edge 301 to prevent any fluid container contents 110 from entering the receptacle through the valve seat hole 218. This is achieved by simply pulling a vacuum through valve stem hole 305. Since this causes the inside of the receptacle to have a negative pressure relative to atmosphere during the container contents filling process, a blast of carbonation pressure further seals the receptacle valve seat recess 207 to the conical stem valve body 301 outer bottom edge 301 and this seal is maintained throughout and after the filling of the container contents 110 and during storage . The container contents pressure $P_B$ pressure difference with the inside of the receptacle 20 will seal off the receptacle valve seat hole 218 so that no container contents 110 can enter into the receptacle 20.

During the manufacturing process, the receptacle 20 is first filled with a water soluble salt 211 such as sodium chlorate which has a heat of solvation of $\Delta H=+21.72$ Kilo joule per mole. Stem valve 30 is assembled with the receptacle 20 as in the previous embodiment. The general shape and sizes of the receptacle and valve stem is the same as in the previous embodiment. Thus, when the receptacle and stem valve assembly 50 is attached to container 100 as in the previous embodiment, and the container contents 110 are sealed inside container 100, the container contents 110 pressure $P_B$ increases and compresses the receptacle bottom wall 204 inwardly and forces the receptacle bottom 204 wall to bow inward into receptacle 20. This forces the valve seat recess 207 to forcibly mate with stem valve outer bottom edge 301 and seal off valve seat hole 218. Since there is no internal refrigerant in the receptacle 20, when container 100 is sealed, the container contents pressure $P_B$ start to slowly permeate through the receptacle 20 walls to mix with the salt crystals 211 and equilibrate inside of receptacle 20 with the container contents pressure.

After equilibration, the valve seat will remain closed by design, since the valve stem 30 is made slightly longer and to snugly mate with valve seat recess 207 by a mechanical force. Thus, the inside surface of valve seat recess 207 and conical stem valve body 301 outer bottom edge will stay forcibly mated and seal off the receptacle valve seat hole 218 so that no container contents 110 can enter into the receptacle 20 through receptacle valve seat hole 218. Receptacle valve seat hole 218 is about $1/8^{th}$ of an inch in diameter. After storage, and when the container contents are desired for consumption, the consumer simply opens the container lid opening means 105 to consume the container contents 110. The product pressure $P_B$ falls to atmospheric pressure, and the carbonation gas trapped under pressure by permeation inside the receptacle 20 causes the receptacle 20 walls to expand irreversibly, and receptacle valve seat recess 207 is pushed away from the stem valve outer bottom edge 301. This expansion of the receptacle valve seat 205 breaks the mating lock between the receptacle valve seat recess 207 and the stem valve outer bottom edge 301. This allows some of the fluid body of container contents 110 to enter into the receptacle 20 through receptacle valve seat hole 218 and permeate the salt crystals 211. The reaction of the water content of the container contents 110 and the salt crystals 211 is endothermic. This results in the cooling of the product 211 by the endothermic reaction of salt crystals and water.

While the above specifications reveal one of many embodiments of the present invention, it must be noted that several different representations of the invention could be constructed by one skilled in the art without limiting the generality of the invention.

I claim as my invention:

1. A self-cooling container apparatus for retaining and cooling container contents in the form of a food item, comprising:

a food container having a container first end and a container second end and having a container wall; said container wall at said container first end terminating in an open container seaming rim and said container wall at said container second end having a container stem valve port, and having a container lid sealingly secured to said container seaming rim, said container lid having a container contents release means for releasing container contents;

a receptacle located within said container and having a receptacle first end adjacent to said container wall and a receptacle second end extending into said container, said receptacle having a receptacle wall including a receptacle stem valve port at said receptacle first end registering with said container stem valve port and including a flexible valve seat portion at said receptacle second end, said receptacle containing a liquified refrigerant;

a stem valve with a substantially tubular stem valve body having a valve body first end and a valve body second end, and having a valve body passageway extending from said valve body first end to said valve body second end, said valve body first end passing sealingly through said receptacle stem valve port and passing sealingly through said container stem valve port, and said valve body second end sealingly bearing against said valve seat to close said valve body passageway;

such that when receptacle pressure inside said receptacle is less than container pressure between said receptacle and said container, the pressure difference between the receptacle pressure and the container pressure produces a resultant pressure on said receptacle wall which sealingly biases said valve seat into sealing contact with said valve body second end, closing fluid communication between said receptacle and said valve body passageway to retain the refrigerant within said receptacle, and such that when the receptacle pressure inside the receptacle is greater than container pressure between said receptacle and said container, the pressure difference between the receptacle pressure and the container pressure produces a resultant pressure on said receptacle wall which moves said valve seat away from the valve body second end, opening fluid communication between said receptacle and said valve body passageway to release the refrigerant from within said receptacle into the atmosphere surrounding said container, thereby cooling the container contents.

2. The self-cooling container apparatus of claim 1, wherein said container bottom wall has an inwardly protruding domed configuration.

3. The self-cooling container apparatus of claim 1, wherein said receptacle wall is thin and flexible.

4. The self-cooling container apparatus of claim 1, wherein said container wall comprises a container bottom wall at said container second end and a cylindrical container side wall extending between and sealingly interconnecting said container lid and said container bottom wall.

5. The self-cooling container apparatus of claim 1, wherein said receptacle wall comprises a receptacle top wall at said receptacle first end and a receptacle bottom wall at said receptacle second end and a receptacle side wall extending between and sealingly interconnecting said receptacle top wall and said receptacle bottom wall.

6. The self-cooling container apparatus of claim 1, wherein said stem valve body is sized to tightly fit and to sealingly plug said receptacle stem valve port and form a gas tight seal.

7. The self-cooling container apparatus of claim 1, wherein said stem valve body additionally comprises a lateral stem valve sealing flange having a flange outward surface for sealingly abutting said container wall adjacent to said container stem valve port and a flange inward surface for sealingly abutting said receptacle bottom wall adjacent to said receptacle stem valve port.

8. The self-cooling container apparatus of claim 7, wherein said valve stem first end comprises a cylindrical protrusion terminating in a smooth surface and having a diameter slightly larger than the diameter of said container stem valve port, such that said cylindrical protrusion is pushed through said container stem valve port until said stem valve sealing flange abuts said container bottom wall, such that said container stem valve port is deformed by said cylindrical protrusion into a conical rim which bites into said cylindrical protrusion and acts as a one way holder for said stem valve and said receptacle inside said container.

9. The self-cooling container apparatus of claim 1, wherein at least one of: said receptacle and said stem valve, comprises form moldable plastic materials.

10. The self-cooling container apparatus of claim 3, wherein said receptacle wall is formed of a thin metal sheet.

11. A self-cooling container apparatus for retaining and cooling container contents in the form of a food item, comprising:

a food container having a container first end and a container second end and having a container wall; said container wall at said container first end terminating in an open container seaming rim and said container wall at said container second end having a container stem valve port, and having a container lid sealingly secured to said container seaming rim, said container lid having a container contents release means for releasing container contents;

a gas permeable receptacle located within said container and having a receptacle first end adjacent to said container wall and a receptacle second end extending into said container, said receptacle having a receptacle wall including a receptacle stem valve port at said receptacle first end registering with said container stem valve port and including a flexible valve seat portion at said receptacle second end, said valve seat portion having a valve seat port, and said receptacle containing a water soluble salt, and said water soluble salt reacting with the water endothermically;

a stem valve with a substantially tubular stem valve body having a valve body first end and a valve body second end, and having a valve body passageway extending from said valve body first end to said valve body second end, said valve body first end passing sealingly through said receptacle stem valve port and passing sealingly through said container stem valve port, and said valve body second end sealingly bearing against said valve seat to close said valve body passageway;

such that when receptacle pressure inside said receptacle is less than container pressure between said receptacle and said container, the pressure difference between the receptacle pressure and the container pressure produces a resultant pressure on said receptacle wall which sealingly biases said valve seat into sealing contact with said valve body second end, closing fluid communication between said receptacle and said valve body passageway to prevent the container contents from entering said receptacle, and such that when receptacle pressure inside said receptacle is greater than container pressure between said receptacle and said container, the pressure difference between the receptacle pressure and the container pressure produces a resultant pressure on said receptacle wall which moves said valve seat away from said valve body second end, opening fluid communication between said receptacle and said valve seat port to permit the container contents to enter said receptacle, thereby causing the water in the container contents to react with the salt endothermically to cool the container contents.

12. The self-cooling container apparatus of claim 11, wherein said salt reacts endothermically with water.

* * * * *